US012807878B2

(12) United States Patent
Bitting et al.

(10) Patent No.: US 12,807,878 B2
(45) Date of Patent: Nov. 24, 2026

(54) CHEMICAL RECYCLING PROCESS COMPRISING MELTING, PYROLYSIS AND CRACKING WASTE PLASTIC

(71) Applicant: ExxonMobil Product Solutions Company, Spring, TX (US)

(72) Inventors: Daryl Bitting, Longview, TX (US); David Eugene Slivensky, Tatum, TX (US); Xianchun Wu, Longview, TX (US); Michael Gary Polasek, Longview, TX (US)

(73) Assignee: ExxonMobil Product Solutions Company, Spring, TX (US)

( * ) Notice: Subject to any disclaimer, the term of this patent is extended or adjusted under 35 U.S.C. 154(b) by 130 days.

(21) Appl. No.: 18/845,527

(22) PCT Filed: Mar. 15, 2023

(86) PCT No.: PCT/US2023/064383

§ 371 (c)(1),
(2) Date: Sep. 10, 2024

(87) PCT Pub. No.: WO2023/178143

PCT Pub. Date: Sep. 21, 2023

(65) Prior Publication Data

US 2025/0188357 A1 Jun. 12, 2025

Related U.S. Application Data

(60) Provisional application No. 63/269,487, filed on Mar. 17, 2022.

(51) Int. Cl.
*C10B 53/00* (2006.01)
*C10B 53/07* (2006.01)
(Continued)

(52) U.S. Cl.
CPC ..... *C10B 53/07* (2013.01); *C10G 1/002* (2013.01); *C10G 1/10* (2013.01); *C10G 2300/1003* (2013.01)

(58) Field of Classification Search
CPC ..... C10B 53/07; C10G 1/002; C10G 1/10
See application file for complete search history.

(56) References Cited

U.S. PATENT DOCUMENTS 3,544,291 A 12/1970 Schlinger et al.
4,220,454 A 9/1980 Ban et al.
(Continued)

FOREIGN PATENT DOCUMENTS

CN 1434015 A 8/2003
CN 203582812 U 5/2014
(Continued)

OTHER PUBLICATIONS

Co-pending U.S. Appl. No. 17/755,326, filed Apr. 27, 2022; Wu et al.
(Continued)

*Primary Examiner* — Jonathan Miller
(74) *Attorney, Agent, or Firm* — C. Tumey Law Group PLLC

(57) ABSTRACT

It has been discovered that the reliance of additional chemical processing facilities downstream of a waste plastic pyrolysis facility may be avoided by utilizing a pyrolysis facility that can both pyrolyse and crack a waste plastic feedstock to thereby form various recycle content products. More specifically, a plastic liquification system and a pyrolysis reactor operating at more severe temperatures and conditions may effectively pyrolyze and crack a waste plastic so that additional downstream processing in a cracking facility may be avoided. Consequently, the waste plastic pyrolysis configuration and process disclosed herein can obtain pro-
(Continued)

cess efficiencies and logistical simplicity not obtainable in previous waste plastic pyrolysis scheme iterations.

20 Claims, 3 Drawing Sheets

(51) Int. Cl.
*C10G 1/00* (2006.01)
*C10G 1/10* (2006.01)

(56) References Cited

U.S. PATENT DOCUMENTS

| | | | | |
|---|---|---|---|---|
| 4,588,850 | A | 5/1986 | Mueller et al. | |
| 5,087,763 | A | 2/1992 | Sorensen | |
| 5,792,340 | A | 8/1998 | Freel et al. | |
| 5,841,011 | A | 11/1998 | Hashimoto et al. | |
| 5,904,879 | A | 5/1999 | Winter et al. | |
| 7,453,393 | B2 | 11/2008 | Duivenvoorden | |
| 7,531,618 | B2 | 5/2009 | DeBruin | |
| 7,893,307 | B2 * | 2/2011 | Smith | C10B 47/44 366/85 |
| 8,183,422 | B2 | 5/2012 | Alegria et al. | |
| 8,895,790 | B2 | 11/2014 | Narayanaswamy et al. | |
| 9,096,801 | B2 | 8/2015 | Baker | |
| 10,246,643 | B2 | 4/2019 | Gephart et al. | |
| 10,421,911 | B2 * | 9/2019 | Ullom | C10B 47/30 |
| 10,655,070 | B2 | 5/2020 | Wheeler et al. | |
| 10,927,315 | B2 * | 2/2021 | Ramamurthy | C10G 51/06 |
| 11,407,947 | B2 * | 8/2022 | Crawford | C10G 1/02 |
| 12,577,472 | B2 * | 3/2026 | Slivensky | C10G 3/40 |
| 2006/0251547 | A1 | 11/2006 | Windes et al. | |
| 2007/0179326 | A1 | 8/2007 | Baker | |
| 2009/0054716 | A1 | 2/2009 | Baumgartner et al. | |
| 2009/0093600 | A1 | 4/2009 | Moore et al. | |
| 2014/0228606 | A1 | 8/2014 | Narayanaswamy et al. | |
| 2015/0080624 | A1 | 3/2015 | Gephart et al. | |
| 2016/0024390 | A1 * | 1/2016 | Ullom | C10G 1/086 202/99 |
| 2016/0122190 | A1 | 5/2016 | Schmelzer et al. | |
| 2016/0264874 | A1 | 9/2016 | Narayanaswamy et al. | |
| 2016/0264885 | A1 | 9/2016 | Narayanaswamy et al. | |
| 2017/0158503 | A1 | 6/2017 | Foody et al. | |
| 2017/0283707 | A1 | 10/2017 | Gephart et al. | |
| 2019/0161683 | A1 | 5/2019 | Narayanaswamy et al. | |
| 2019/0177626 | A1 * | 6/2019 | Ramamurthy | C10G 69/06 |
| 2019/0390124 | A1 | 12/2019 | Oprins et al. | |
| 2020/0017772 | A1 | 1/2020 | Ramamurthy et al. | |
| 2020/0362248 | A1 | 11/2020 | Cartolano et al. | |
| 2021/0130699 | A1 | 5/2021 | Bitting et al. | |
| 2021/0130708 | A1 | 5/2021 | Xu et al. | |
| 2021/0130710 | A1 | 5/2021 | Xu et al. | |
| 2021/0130712 | A1 | 5/2021 | Abudawoud et al. | |
| 2021/0130713 | A1 | 5/2021 | Xu et al. | |
| 2021/0130714 | A1 | 5/2021 | Abudawoud et al. | |
| 2021/0130715 | A1 | 5/2021 | Xu et al. | |
| 2021/0130717 | A1 | 5/2021 | Xu et al. | |
| 2021/0189252 | A1 * | 6/2021 | Timken | C10B 53/07 |
| 2024/0368475 | A1 * | 11/2024 | Bitting | C10G 1/10 |
| 2024/0376383 | A1 * | 11/2024 | Slivensky | C10B 53/07 |
| 2024/0400906 | A1 * | 12/2024 | Bitting | C10B 53/07 |
| 2025/0188357 | A1 * | 6/2025 | Bitting | C10B 53/07 |
| 2025/0188363 | A1 * | 6/2025 | Slivensky | C10G 9/38 |
| 2025/0188365 | A1 * | 6/2025 | Hampton, Jr. | C10G 1/10 |
| 2025/0197728 | A1 * | 6/2025 | Bitting | C10G 1/02 |

FOREIGN PATENT DOCUMENTS

| | | | |
|---|---|---|---|
| CN | 105238434 | B1 | 3/2017 |
| CN | 112760116 | A | 5/2021 |
| CN | 215886918 | U | 2/2022 |
| EP | 0659867 | A2 | 6/1995 |
| EP | 0662503 | A1 | 7/1995 |
| FI | 20 205 131 | A1 | 12/2020 |
| JP | 07-216364 | A | 8/1995 |
| JP | H11 116728 | A | 4/1999 |
| JP | 2000176403 | A | 6/2000 |
| JP | 2000313892 | A | 11/2000 |
| JP | 2018-511671 | A | 4/2018 |
| KR | 10-2000-0023759 | A | 4/2000 |
| WO | WO 95/09902 | A1 | 4/1995 |
| WO | WO 2004/018592 | A1 | 3/2004 |
| WO | WO 2010/051013 | A1 | 5/2010 |
| WO | WO 2010/062307 | A1 | 6/2010 |
| WO | WO 2015/100430 | A1 | 7/2015 |
| WO | WO 2016/142809 | A1 | 9/2016 |
| WO | WO 2017/146876 | A1 | 8/2017 |
| WO | WO 2018/005074 | A1 | 1/2018 |
| WO | WO 2018/055555 | A1 | 3/2018 |
| WO | WO 2018/069794 | A1 | 4/2018 |
| WO | WO 2019/056138 | A1 | 3/2019 |
| WO | WO 2020/252228 | A1 | 12/2020 |
| WO | WO 2021/063961 | A1 | 4/2021 |
| WO | WO 2021/084016 | A1 | 5/2021 |
| WO | WO 2021/087032 | A1 | 5/2021 |
| WO | WO 2021/087038 | A1 | 5/2021 |
| WO | WO 2021/087057 | A1 | 5/2021 |
| WO | WO 2021/087059 | A1 | 5/2021 |
| WO | WO 2021/087066 | A1 | 5/2021 |
| WO | WO 2021/163094 | A1 | 8/2021 |
| WO | WO 2021/163106 | A1 | 8/2021 |
| WO | WO 2021/163113 | A1 | 8/2021 |
| WO | WO 2021/163123 | A1 | 8/2021 |
| WO | WO 2021/211529 | A1 | 10/2021 |
| WO | WO 2023/049025 | A1 | 3/2023 |
| WO | WO 2023/049040 | A1 | 3/2023 |

OTHER PUBLICATIONS

USPTO Office Action dated Oct. 12, 2023 received in co-pending U.S. Appl. No. 17/755,326.
USPTO Office Action dated Jun. 13, 2024 received in co-pending U.S. Appl. No. 17/755,326.
USPTO Office Action dated Dec. 4, 2024 received in co-pending U.S. Appl. No. 17/755,326.
Co-pending U.S. Appl. No. 17/083,592, filed Oct. 29, 2020; Wu. et al.
USPTO Office action dated Feb. 3, 2022 received in co-pending U.S. Appl. No. 17/083,592.
USPTO Office action dated Sep. 12, 2022 received in co-pending U.S. Appl. No. 17/083,592.
USPTO Office action dated Feb. 24, 2023 received in co-pending U.S. Appl. No. 17/083,592.
USPTO Office action dated Oct. 19, 2023 received in co-pending U.S. Appl. No. 17/083,592.
USPTO Office action dated Aug. 1, 2024 received in co-pending U.S. Appl. No. 17/083,592.
USPTO Office action dated Apr. 25, 2025 received in co-pending U.S. Appl. No. 17/083,592.
USPTO Office Action dated Jun. 6, 2025 received co-pending U.S. Appl. No. 17/755,326.
Co-pending U.S. Appl. No. 17/995,713, filed Oct. 7, 2022; DeBruin et al.
Co-pending U.S. Appl. No. 18/558,376, filed Nov. 1, 2023; Slivensky et al.
Co-pending U.S. Appl. No. 18/692,913, filed Mar. 18, 2024; Polasek et al.
Co-pending U.S. Appl. No. 18/691,476, filed Mar. 13, 2024; Wu et al.
Co-pending U.S. Appl. No. 18/692,880, filed Mar. 18, 2024; Anderson et al.
Co-pending U.S. Appl. No. 18/692,904, filed Mar. 18, 2024; Anderson et al.
Co-pending U.S. Appl. No. 18/691,643, filed Mar. 13, 2024; Slivensky et al.
Co-pending U.S. Appl. No. 18/691,481, filed Mar. 13, 2024; Slivensky et al.
Co-pending U.S. Appl. No. 18/691,596, filed Mar. 13, 2024; Slivensky et al.

(56) References Cited

OTHER PUBLICATIONS

Co-pending U.S. Appl. No. 18/691,472, filed Mar. 13, 2024; Wu et al.
Co-pending U.S. Appl. No. 18/691,100, filed Mar. 12, 2024; Bitting et al.
Co-pending U.S. Appl. No. 18/847,292, filed Sep. 16, 2024; Bitting et al.
Co-pending U.S. Appl. No. 18/845,490, filed Sep. 10, 2024; Slivensky et al.
Notification of Transmittal of the International Search Report and the Written Opinion of the International Searching Authority, or the Declaration; International Application No. PCT/US2020/057873 with a mailing date of Feb. 22, 2021.
Notification of Transmittal of the International Search Report and the Written Opinion of the International Searching Authority, or the Declaration; International Application No. PCT/US2021/027007 with a mailing date of Jul. 30, 2021.
Notification of Transmittal of the International Search Report and the Written Opinion of the International Searching Authority with Date of Mailing Aug. 25, 2022 for International Application No. PCT/US2022/026679.
Notification of Transmittal of the International Search Report and the Written Opinion of the International Searching Authority with Date of Mailing Dec. 9, 2022 for International Application No. PCT/US2022/043746.
Notification of Transmittal of the International Search Report and the Written Opinion of the International Searching Authority with Date of Mailing Dec. 13, 2022 for International Application No. PCT/US2022/043744.
Notification of Transmittal of the International Search Report and the Written Opinion of the International Searching Authority with Date of Mailing Dec. 19, 2022 for International Application No. PCT/US2022/043755.
Notification of Transmittal of the International Search Report and the Written Opinion of the International Searching Authority with Date of Mailing Dec. 28, 2022 for International Application No. PCT/US2022/043749.
Notification of Transmittal of the International Search Report and the Written Opinion of the International Searching Authority with Date of Mailing Dec. 30, 2022 for International Application No. PCT/US2022/043747.
Notification of Transmittal of the International Search Report and the Written Opinion of the International Searching Authority with Date of Mailing Jan. 2, 2023 for International Application No. PCT/US2022/043751.
Notification of Transmittal of the International Search Report and the Written Opinion of the International Searching Authority with Date of Mailing Feb. 24, 2023 for International Application No. PCT/US2022/043753.
Notification of Transmittal of the International Search Report and the Written Opinion of the International Searching Authority with Date of Mailing Feb. 27, 2023 for International Application No. PCT/US2022/043743.
Notification of Transmittal of the International Search Report and the Written Opinion of the International Searching Authority, or the Declaration; International Application No. PCT/US2023/064379 with a mailing date of Jul. 3, 2023.
Notification of Transmittal of the International Search Report and the Written Opinion of the International Searching Authority, or the Declaration; International Application No. PCT/US2022/043766 with a mailing date of Dec. 5, 2022.
Notification of Transmittal of the International Search Report and the Written Opinion of the International Searching Authority, or the Declaration; International Application No. PCT/US2022/064371 with a mailing date of Jun. 19, 2023.
Notification of Transmittal of the International Search Report and the Written Opinion of the International Searching Authority, or the Declaration; International Application No. PCT/US2023/064383 with a mailing date of Jun. 14, 2023.
Li, Fuwei et al.; Production of light olefins from catalytic cracking bio-oil model compounds over La203-modified ZSM-5 zeolite; Energy & Fuels, 2018, col. 32, No. 5, pp. 5910-5922.
Oliveira, Carina et al.; "Decarbonisation options for large volume organic chemicals production", Sabic Geleen Manufacturing Industry Decarbonisation Data Exchange Network; May 4, 2021; Figures 25,26; Table 14; pp. 42-44.
Zhiyuan, Button et al.; "The release law of benzene, radon and fife in the process of pyrococosatic and plastic pyrolytic process"; Environmental Chemistry, vol. 1 27, No. 6, Nov. 2008, pp. 766-796.
Zimmerman, Heinz et al.; "Ethylene" Ullman's Encyclopedia od Industrial Chemistry; Apr. 15, 2009; tables 3-9; figures 32-36.
ASTMD2887; "Standard Test Method for Boiling Range Distribution of Petroleum Fractions by Gas Chromatography"; Published Dec. 2023.
ASTMD5399; "Standard Test Method for Boiling Point Distribution of Hydrocarbon Solvents by Gas Chromatography"; Published Aug. 2023.

* cited by examiner

CHEMICAL RECYCLING PROCESS COMPRISING MELTING, PYROLYSIS AND CRACKING WASTE PLASTIC

CROSS-REFERENCE TO RELATED APPLICATION(S)

This application is a national stage filing under 35 USC § 371 of International Application Number PCT/US2023/064383, filed on Mar. 15, 2023, which claims the benefit of the filing date to U.S. Provisional Application No. 63/269,487, filed on Mar. 17, 2022, the entire disclosures of which are incorporated by reference herein.

BACKGROUND

Waste plastic pyrolysis plays a part in a variety of chemical recycling technologies. The pyrolysis of waste plastic produces heavy components (e.g., waxes, tar, and char), as well as recycle content pyrolysis oil (r-pyoil) and recycle content pyrolysis gas (r-pygas). When the pyrolysis facility is located near another processing facility, such as a cracker facility, it is desirable to send as much of the r-pyoil and r-pygas as possible to the downstream processing facility to be used as a feedstock in forming other recycle content products (e.g., olefins, paraffins, etc.).

However, the reliance of downstream processing facilities, such as a cracking facility, can increase operation costs and complicate logistics when trying to produce recycle content products from the pyrolysis products. Furthermore, the combination of pyrolysis facilities and other downstream processing facilities may only be feasible if such facilities are located close to each other or within close proximity to major transportation pathways, such as railroads, waterways, or highways. Thus, a processing scheme for waste plastic pyrolysis that mitigates the need for additional downstream processing facilities is needed.

SUMMARY

In one aspect, the present technology concerns a chemical recycling process. Generally, the process comprises: (a) melting a solid waste plastic in a plastic liquification system to thereby form a pyrolysis effluent stream having a temperature of at least 500° C.; and (b) pyrolyzing at least a portion of the pyrolysis effluent stream in a pyrolysis reactor at a temperature of at least 650° C. to thereby form a pyrolysis vapor stream.

In one aspect, the present technology concerns a chemical recycling process. Generally, the process comprises: (a) melting a solid waste plastic in a plastic liquification system to thereby form a pyrolysis effluent stream; (b) pyrolyzing at least a portion of the pyrolysis effluent stream in a pyrolysis reactor at a temperature of at least 650° C. to thereby form a pyrolysis vapor stream; and (c) introducing at least a portion of the pyrolysis vapor into a compression system.

In one aspect, the present technology concerns a chemical recycling process. Generally, the process comprises: (a) melting a solid waste plastic in a plastic liquification system to thereby form a pyrolysis effluent stream having a temperature of at least 400° C.; and (b) pyrolyzing at least a portion of the pyrolysis effluent stream in a pyrolysis reactor at a temperature of at least 650° C. to thereby form a pyrolysis vapor stream. Additionally, the pyrolysis vapor stream contains: (i) at least 10 weight percent of ethylene, (ii) at least 10 weight percent of propylene, (iii) at least 3 weight percent of methane, (iv) less than 10 weight percent of butylenes, (v) less than 10 weight percent of C6-C9 hydrocarbons, and (vi) less than 15 weight percent of C10-C25 hydrocarbons.

In one aspect, the present technology concerns a chemical recycling process. Generally, the process comprises: (a) melting a solid waste plastic in a plastic liquification vessel to thereby form liquefied waste plastic having a temperature of at least 275° C.; (b) heating at least a portion of the liquefied waste plastic in a heating vessel to thereby form a pyrolysis effluent stream having a temperature of at least 400° C.; and (c) pyrolyzing at least a portion of the pyrolysis effluent stream in a pyrolysis reactor at a temperature of at least 650° C. to thereby form a pyrolysis vapor stream. Furthermore, each of the plastic liquification vessel, the heating vessel, and the pyrolysis reactor are heated via an electrical heat source.

In one aspect, the present technology concerns a chemical recycling process. Generally, the process comprises: (a) melting a solid waste plastic in a plastic liquification vessel to thereby form liquefied waste plastic having a temperature of at least 275° C.; (b) heating at least a portion of the liquefied waste plastic in a heating vessel to thereby form a pyrolysis effluent stream having a temperature of at least 400° C.; (c) pyrolyzing at least a portion of the pyrolysis effluent stream in a pyrolysis reactor at a temperature of at least 650° C. to thereby form a pyrolysis vapor stream; and (d) introducing at least a portion of the pyrolysis vapor stream into a compression system.

DETAILED DESCRIPTION

We have discovered that the reliance on additional chemical processing facilities downstream of a waste plastic pyrolysis facility may be avoided by utilizing a plastic liquification system and a pyrolysis reactor that can both pyrolyze and crack a waste plastic feedstock to thereby form various recycle content products. In other words, the plastic liquification system and the pyrolysis reactor described herein may effectively pyrolyze and crack a waste plastic so that additional downstream processing in a cracking facility may be avoided. Consequently, the waste plastic pyrolysis configuration and process disclosed herein can achieve process efficiencies and logistical simplicity not obtainable in previous iterations of waste plastic pyrolysis schemes.

Figure 1:
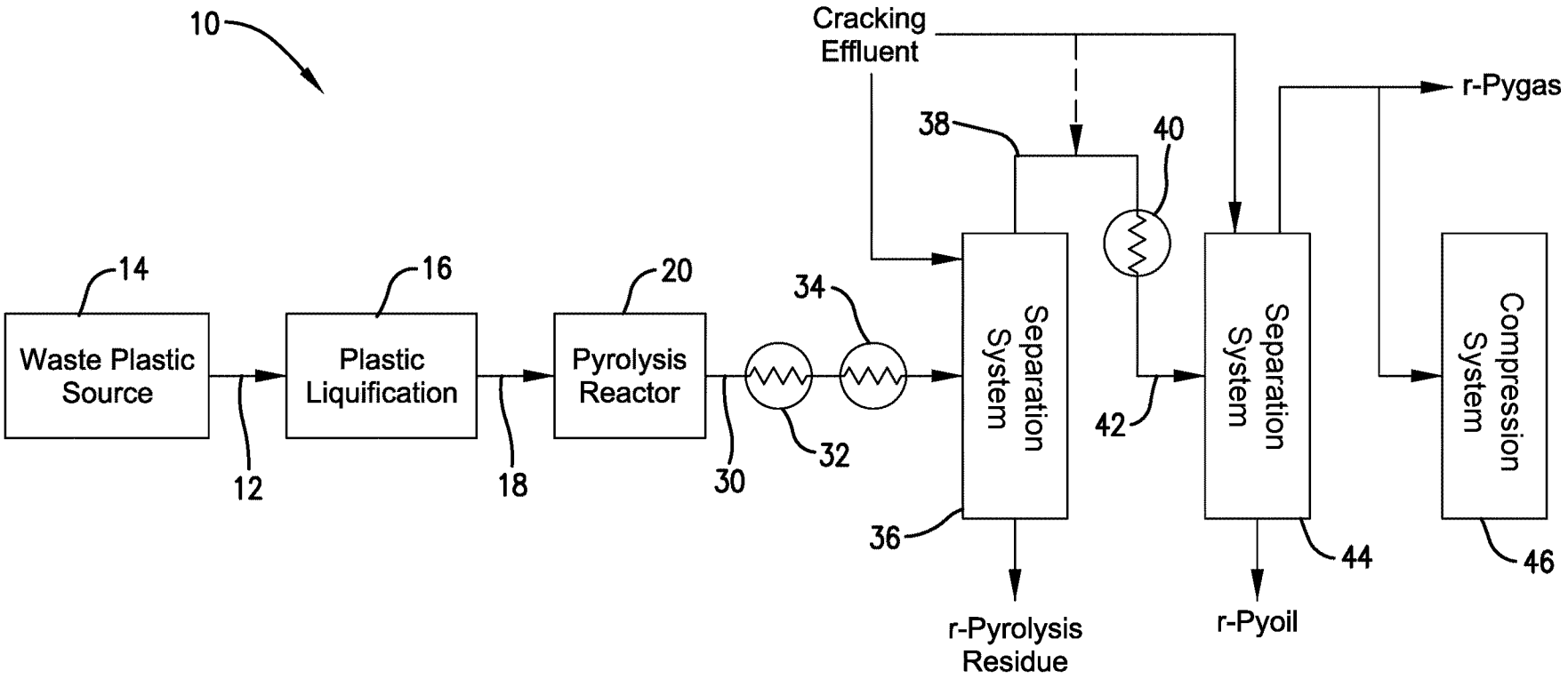
FIG. 1 is a block flow diagram illustrating the initial steps of a process and facility for chemically recycling waste plastic according to embodiments of the present technology.

FIG. 1 depicts an exemplary chemical recycling facility comprising a pyrolysis facility (e.g., the plastic liquification system and the pyrolysis reactor). The chemical recycling facility 10 described herein is able to effectively pyrolyze and crack a waste plastic stream without the need for a downstream processing facility, such as a cracking facility including a cracker furnace. It should be understood that FIG. 1 depicts one exemplary embodiment of the present technology. Certain features depicted in FIG. 1 may be omitted and/or additional features described elsewhere herein may be added to the system depicted in FIG. 1. The various process steps are described below in greater detail.

Overall Chemical Recycling Facility

Turning now to FIG. 1, the main steps of a process for chemically recycling waste plastic in a chemical recycling facility 10 are shown. Chemical recycling processes and facilities as described herein may be used to convert waste plastic to recycle content products or chemical intermediates used to form a variety of end use materials. The waste plastic 12 fed to the chemical recycling facility/process can be mixed plastic waste (MPW), pre-sorted waste plastic, and/or pre-processed waste plastic. As shown in FIG. 1, the waste plastic feed stream 12 may be derived from the waste plastic source 14, which may include a waste plastic preprocessing facility.

In an embodiment or in combination with any embodiment mentioned herein, the chemical recycling facility 10 may be a commercial-scale facility capable of processing significant volumes of mixed plastic waste. As used herein, the term "commercial scale facility" refers to a facility having an average annual feed rate of at least 500 pounds per hour, averaged over one year.

In an embodiment or in combination with any embodiment mentioned herein, two or more of the facilities of the chemical recycling facility, such as the pyrolysis facility and the waste plastic source, may be co-located with one another. As used herein, the term "co-located" refers to facilities in which at least a portion of the process streams and/or supporting equipment or services are shared between the two facilities. When two or more of the facilities shown in FIG. 1 are co-located, the facilities may meet at least one of the following criteria (i) through (v): (i) the facilities share at least one non-residential utility service; (ii) the facilities share at least one service group; (iii) the facilities are owned and/or operated by parties that share at least one property boundary; (iv) the facilities are connected by at least one conduit configured to carry at least one process material (e.g., solid, liquid and/or gas fed to, used by, or generated in a facility) from one facility to another; and (v) the facilities are within 40, within 35, within 30, within 20, within 15, within 12, within 10, within 8, within 5, within 2, or within 1 mile of one another, measured from their geographical center. At least one, at least two, at least three, at least four, or all of the above statements (i) through (v) may be true.

Regarding (i), examples of suitable utility services include, but are not limited to, steam systems (co-generation and distribution systems), cooling water systems, heat transfer fluid systems, plant or instrument air systems, nitrogen systems, hydrogen systems, non-residential electrical generation and distribution, including distribution above 8000V, non-residential wastewater/sewer systems, storage facilities, transport lines, flare systems, and combinations thereof.

Regarding (ii), examples of service groups and facilities include, but are not limited to, emergency services personnel (fire and/or medical), a third-party vendor, a state or local government oversight group, and combinations thereof. Government oversight groups can include, for example, regulatory or environmental agencies, as well as municipal and taxation agencies at the city, county, and state level.

Regarding (iii), the boundary may be, for example, a fence line, a property line, a gate, or common boundaries with at least one boundary of a third-party owned land or facility.

Regarding (iv), the conduit may be a fluid conduit that carries a gas, a liquid, a solid/liquid mixture (e.g., slurry), a solid/gas mixture (e.g., pneumatic conveyance), a solid/liquid/gas mixture, or a solid (e.g., belt conveyance). In some cases, two units may share one or more conduits selected from the above list.

Turning again to FIG. 1, a stream of waste plastic 12, which can be mixed plastic waste (MPW), may be introduced into the chemical recycling facility 10 from the waste plastic source 14. As used herein, the terms "waste plastic" and "plastic waste" refer to used, scrap, and/or discarded plastic materials, such as plastic materials typically sent to a landfill. The waste plastic stream fed to the chemical recycling facility may include unprocessed or partially processed waste plastic. As used herein, the term "unprocessed waste plastic" means waste plastic that has not be subjected to any automated or mechanized sorting, washing, or comminuting. Examples of unprocessed waste plastic include waste plastic collected from household curbside plastic recycling bins or shared community plastic recycling containers. Partially processed waste plastics may originate from, for example, municipal recycling facilities (MRFs) or reclaimers. In certain embodiments, the waste plastic may comprise at least one of post-industrial (or pre-consumer) plastic and/or post-consumer plastic.

In an embodiment or in combination with any embodiment mentioned herein, the mixed waste plastic (MPW) 12 includes at least two distinct types of plastic.

In an embodiment or in combination with any embodiment mentioned herein, all or a portion of the MPW in the waste plastic stream 12 can originate from a municipal recycling facility (MRF).

In an embodiment or in combination with any embodiment mentioned herein, all or a portion of the MPW in the waste plastic stream 12 can originate from a reclaimer facility.

Examples of suitable waste plastics can include, but are not limited to, polyolefins (PO), aromatic and aliphatic polyesters, polyvinyl chloride (PVC), polystyrene, cellulose esters, polytetrafluoroethylene, acrylobutadienestyrene (ABS), cellulosics, epoxides, polyamides, phenolic resins, polyacetal, polycarbonates, polyphenylene-based alloys, poly(methyl methacrylate), styrene-containing polymers, polyurethane, vinyl-based polymers, styrene acrylonitrile, and urea-containing polymers and melamines.

Examples of specific polyolefins may include linear low-density polyethylene (LLDPE), low density polyethylene (LDPE), polymethylpentene, polybutene-1, high density polyethylene (HDPE), atactic polypropylene, isotactic polypropylene, syndiotactic polypropylene, crosslinked polyethylene, amorphous polyolefins, and the copolymers of any one of the aforementioned polyolefins.

Examples of polyesters can include those having repeating aromatic or cyclic units such as those containing a repeating terephthalate, isophthalate, or naphthalate units such as PET, modified PET, and PEN, or those containing repeating furanate repeating units. As used herein, "PET" or "polyethylene terephthalate" refers to a homopolymer of polyethylene terephthalate, or to a polyethylene terephthalate modified with one or more acid and/or glycol modifiers and/or containing residues or moieties of other than ethylene glycol and terephthalic acid, such as isophthalic acid, 1,4-cyclohexanedicarboxylic acid, diethylene glycol, 2,2,4,4-tetramethyl-1,3-cyclobutanediol (TMCD), cyclohexanedimethanol (CHDM), propylene glycol, isosorbide, 1,4-butanediol, 1,3-propane diol, and/or neopentyl glycol (NPG).

In an embodiment or in combination with any embodiment mentioned herein, the waste plastic stream 12 comprises at least 20, at least 25, at least 30, at least 35, at least 40, at least 45, at least 50, at least 55, at least 60, at least 65, at least 70, at least 75, at least 80, at least 85, at least 90, at least 95, or at least 99 weight percent of one or more polyolefins, based on the total weight of the stream. Alternatively, or in addition, the waste plastic stream 12 comprises not more than 99.9, not more than 99, not more than 97, not more than 92, not more than 90, not more than 85, not more than 80, not more than 75, not more than 70, not more than 65, not more than 60, not more than 55, not more than 50, not more than 45, not more than 40, not more than 35, not more than 30, not more than 25, not more than 20, not more than 15, not more than 10, or not more than 5 weight percent of one or more polyolefins, based on the total weight of the stream.

In one embodiment or in combination with any of the mentioned embodiments, the waste plastic stream 12 comprises not more than 20, not more than 15, not more than 12, not more than 10, not more than 8, not more than 6, not more than 5, not more than 4, not more than 3, not more than 2, or not more than 1 weight percent of polyesters, based on the total weight of the stream.

In one embodiment or in combination with any of the mentioned embodiments, the waste plastic stream 12 comprises not more than 20, not more than 15, not more than 12, not more than 10, not more than 8, not more than 6, not more than 5, not more than 4, not more than 3, not more than 2, or not more than 1 weight percent of biowaste materials, based on the total weight of the stream. As used herein, the term "biowaste" refers to material derived from living organisms or of organic origin. Exemplary biowaste materials include, but are not limited to, cotton, wood, saw dust, food scraps, animals and animal parts, plants and plant parts, and manure.

In an embodiment or in combination with any embodiment mentioned herein, the waste plastic stream 12 can include not more than 10, not more than 5, not more than 4, not more than 3, not more than 2, not more than 1, not more than 0.75, or not more than 0.5 weight percent of polyvinyl chloride (PVC), based on the total weight of the stream.

The general configuration and operation of each of the facilities that may be present in the chemical recycling facility 10 shown in FIG. 1 will now be described in further detail below, beginning with the optional preprocessing facility of the waste plastic source 14.

Optional Plastic Preprocessing

As shown in FIG. 1, unprocessed, partially processed, and/or processed waste plastic, such as mixed plastic waste (MPW), may first be introduced into the chemical recycling facility 10 via the waste plastic stream 12 from the waste plastic source 14. As noted above, the waste plastic source may include an optional preprocessing facility that can prepare the waste plastic feedstock for the downstream recycling processes. While in the optional preprocessing facility, the waste plastic feedstock may undergo one or more preprocessing steps to prepare it for chemical recycling. As used herein, the term "preprocessing facility" refers to a facility that includes all equipment, lines, and controls necessary to carry out the preprocessing of waste plastic. Preprocessing facilities as described herein may employ any suitable method for carrying out the preparation of waste plastic for chemical recycling using one or more of following steps, which are described in further detail below. Alternatively, in certain embodiments, the waste plastic source does not contain a preprocessing facility and the waste plastic stream is not subjected to any preprocessing before any of the downstream chemical recycling steps described herein.

In an embodiment or in combination with any embodiment mentioned herein, the preprocessing facility of the waste plastic source may include at least one separation step or zone. The separation step or zone may be configured to separate the waste plastic stream into two or more streams enriched in certain types of plastics. Such separation is particularly advantageous when the waste plastic fed to the chemical recycling facility is MPW.

Any suitable type of separation device, system, or facility may be employed to separate the waste plastic into two or more streams enriched in certain types of plastics such as, for example, a PET-enriched stream and a PO-enriched stream. Examples of suitable types of separation include mechanical separation and density separation, which may include sink-float separation and/or centrifugal density separation. As used herein, the term "sink-float separation" refers to a density separation process where the separation of materials is primarily caused by floating or sinking in a selected liquid medium, while the term "centrifugal density separation" refers to a density separation process where the separation of materials is primarily caused by centrifugal forces.

Referring again to FIG. 1, the waste plastic stream 12 may be introduced into one or more downstream processing facilities (or undergo one or more downstream processing steps) within the chemical recycling facility 10. In an embodiment or in combination with any embodiment mentioned herein, at least a portion of the waste plastic stream 12 may be directly or indirectly introduced into a plastic liquification system 16 within the waste plastic source 14 or outside of it. Additional details of each step, as well as the general integration of each of these steps or facilities with one or more of the others according to one or more embodiments of the present technology are discussed in further detail below.

Liquification/Dehalogenation

As shown in FIG. 1, the waste plastic stream 12 may be introduced into a plastic liquification system 16 prior to being introduced into the pyrolysis reactor 20. As used herein, the term "liquification" system refers to chemical processing zone(s) or step(s) in which at least a portion of the incoming plastic is liquefied and at least partially pyrolyzed. The step of liquefying plastic in FIG. 1 can include chemical liquification, physical liquification, or combinations thereof. Exemplary methods of liquefying the plastic introduced in the liquification system 16 can include: (i) heating/melting; (ii) dissolving in a solvent; (iii) depolymerizing; (iv) plasticizing; and combinations thereof. Additionally, one or more of options (i) through (iv) may also be accompanied by the addition of a blending or liquification agent to help facilitate the liquification (reduction of viscosity) of the polymer material. As such, a variety of rheology modification agents (e.g., solvents, depolymerization agents, plasticizers, and blending agents) can be used the enhance the flow and/or dispersibility of the liquified waste plastic.

When added to the liquification system 16, at least 50, at least 55, at least 60, at least 65, at least 70, at least 75, at least 80, at least 85, at least 90, at least 95, or at least 99 weight percent of the plastic (usually waste plastic) originally present in the waste plastic stream undergoes a reduction in viscosity. In some cases, the reduction in viscosity can be facilitated by heating (e.g., addition of steam directly or indirectly contacting the plastic), while, in other cases, it can be facilitated by combining the plastic with a solvent capable of dissolving it. Examples of suitable solvents can include, but are not limited to, alcohols such as methanol or ethanol, glycols such as ethylene glycol, diethylene glycol, triethylene glycol, neopentyl glycol, cyclohexanedimethanol, glycerin, pyrolysis oil, motor oil, and water. This dissolution solvent can be added directly to the liquification vessel in the liquification system 16, or it can be previously combined with one or more streams fed to the liquification system 16, including the waste plastic stream.

In an embodiment or in combination with any embodiment mentioned herein, the dissolution solvent can comprise a stream withdrawn from one or more other facilities within the chemical recycling facility. For example, the solvent can comprise a stream withdrawn from the pyrolysis reactor. In certain embodiments, the dissolution solvent can be or comprise pyrolysis oil.

In some cases, the waste plastic can be depolymerized such that, for example, the number average chain length of the plastic is reduced by contact with a depolymerization agent. In an embodiment or in combination with any embodiment mentioned herein, at least one of the previously-listed solvents may be used as a depolymerization agent, while, in one or more other embodiments, the depolymerization agent can include an organic acid (e.g., acetic acid, citric acid, butyric acid, formic acid, lactic acid, oleic acid, oxalic, stearic acid, tartaric acid, and/or uric acid) or inorganic acid such as sulfuric acid (for polyolefins). The depolymerization agent may reduce the melting point and/or viscosity of the polymer by reducing its number average chain length.

Alternatively, or additionally, a plasticizer can be used in the liquification system 16 to reduce the viscosity of the plastic. Plasticizers for polyethylene include, for example, dioctyl phthalate, dioctyl terephthalate, glyceryl tribenzoate, polyethylene glycol having molecular weight of up to 8,000 Daltons, sunflower oil, paraffin wax having molecular weight from 400 to 1,000 Daltons, paraffinic oil, mineral oil, glycerin, EPDM, and EVA. Plasticizers for polypropylene include, for example, dioctyl sebacate, paraffinic oil, isooctyl tallate, plasticizing oil (Drakeol 34), naphthenic and aromatic processing oils, and glycerin. Plasticizers for polyesters include, for example, polyalkylene ethers (e.g., polyethylene glycol, polytetramethylene glycol, polypropylene glycol or their mixtures) having molecular weight in the range from 400 to 1500 Daltons, glyceryl monostearate, octyl epoxy soyate, epoxidized soybean oil, epoxy tallate, epoxidized linseed oil, polyhydroxyalkanoate, glycols (e.g., ethylene glycol, pentamethylene glycol, hexamethylene glycol, etc.), phthalates, terephthalates, trimellitate, and polyethylene glycol di-(2-ethylhexoate). When used, the plasticizer may be present in an amount of at least 0.1, at least 0.5, at least 1, at least 2, or at least 5 weight percent and/or not more than 10, not more than 8, not more than 5, not more than 3, not more than 2, or not more than 1 weight percent, based on the total weight of the waste plastic stream, or it can be in a range of from 0.1 to 10 weight percent, 0.5 to 8 weight percent, or 1 to 5 weight percent, based on the total weight of the waste plastic stream.

Further, one or more of the methods of liquefying the waste plastic stream can also include adding at least one blending agent to the plastic stream before, during, or after the liquification process in the liquification system 16. Such blending agents may include for example, emulsifiers and/or surfactants, and may serve to more fully blend the liquified plastic into a single phase, particularly when differences in densities between the plastic components of a mixed plastic stream result in multiple liquid or semi-liquid phases. When used, the blending agent may be present in an amount of at least 0.1, at least 0.5, at least 1, at least 2, or at least 5 weight percent and/or not more than 10, not more than 8, not more than 5, not more than 3, not more than 2, or not more than 1 weight percent, based on the total weight of the waste plastic stream, or it can be in a range of from 0.1 to 10 weight percent, 0.5 to 8 weight percent, or 1 to 5 weight percent, based on the total weight of the waste plastic stream.

In an embodiment or in combination with any embodiment mentioned herein, a portion of the pyrolysis oil stream from the pyrolysis reactor can be combined with the waste plastic stream to form a liquified plastic. Generally, in such embodiments, all or a portion of the pyrolysis oil stream may be combined with the waste plastic stream prior to introduction into the liquification system 16, or after the waste plastic stream 12 enters the liquification vessel within the liquification system 16.

In an embodiment or in combination with any embodiment mentioned herein, the waste plastic stream 12 fed into the liquification system 16 can include at least 1, at least 5, at least 10, at least 15, at least 20, at least 25, at least 30, at least 35, at least 40, at least 45, at least 50, at least 55, at least 60, at least 65, at least 70, at least 75, at least 80, at least 85, at least 90, at least 95, or at least 99 weight percent and/or not more than 95, not more than 90, not more than 85, not more than 80, not more than 75, not more than 70, not more than 65, not more than 60, not more than 55, not more than 50, not more than 45, not more than 40, not more than 35, not more than 30, not more than 25, not more than 20, not more than 15, not more than 10, not more than 5, not more than 2, or not more than 1 weight percent of one or more polyolefins, based on the total weight of the stream, or the amount of polyolefins can be in the range of from 1 to 99 weight percent, 5 to 90 weight percent, or 10 to 85 weight percent, based on the total weight of the stream.

In an embodiment or in combination with any embodiment mentioned herein, the liquified plastic stream 18 formed within the plastic liquification system 16 can have a viscosity of less than 3,000, less than 2,500, less than 2,000, less than 1,500, less than 1,000, less than 800, less than 750, less than 700, less than 650, less than 600, less than 550, less than 500, less than 450, less than 400, less than 350, less than 300, less than 250, less than 150, less than 100, less than 75, less than 50, less than 25, less than 10, less than 5, or less than 1 poise, as measured using a Brookfield R/S rheometer with a V80-40 vane spindle operating at a shear rate of 10 rad/s and a temperature of 350° C.

In an embodiment or in combination with any embodiment mentioned herein, the plastic liquification system 16 may comprise at least one, at least two, at least three, or at least four liquification vessels to facilitate the liquefying and pyrolysis of the waste plastics prior to the pyrolysis reactor. In various embodiments, the liquification vessels can include at least one melt tank and/or at least one extruder to facilitate the plastic liquification and pyrolysis of the plastics. Additionally, in certain embodiments, the liquification system 16 may also contain at least one stripping column and at least one disengagement vessel to facilitate the removal of halogenated compounds that may be formed in the liquification vessel(s).

In an embodiment or in combination with any embodiment mentioned herein, the melt tanks can include one or more continuously stirred tanks. When one or more rheology modification agents (e.g., solvents, depolymerization agents, plasticizers, and blending agents) are used in the liquification system, such rheology modification agents can be added to and/or mixed with the waste plastic stream in or prior to introduction into the melt tank(s).

In an embodiment or in combination with any embodiment mentioned herein, the liquification vessel(s), such as the melt tanks and/or the extruders, may receive the waste plastic feed stream and heat the waste plastic via heating mechanisms in the melt tank and/or via the extrusion process in the extruder.

In an embodiment or in combination with any embodiment mentioned herein, the interior space of the liquification vessel(s), where the plastic is liquefied and/or pyrolyzed, may be maintained at a temperature of at least 200, at least 210, at least 220, at least 230, at least 240, at least 250, at least 260, at least 270, at least 280, at least 290, at least 300, at least 310, at least 320, at least 330, at least 340, at least 350, at least 360, at least 370, at least 380, at least 390, at least 400, at least 410, at least 420, at least 430, at least 440, at least 450, at least 460, at least 470, at least 480, at least 490, at least 500, at least 510, at least 515, at least 520, at least 525, at least 530, at least 535, at least 540, at least 545, or at least 550° C. Additionally, or in the alternative, the interior space of the liquification vessel(s) may be maintained at a temperature of not more than 600, not more than 590, not more than 580, not more than 570, not more than 560, not more than 550, not more than 500, not more than 475, not more than 450, not more than 425, not more than 400, not more than 390, not more than 380, not more than 370, not more than 365, not more than 360, not more than 355, not more than 350, or not more than 345° C. Generally, in one or more embodiments, the interior space of the liquification vessel(s) may be maintained at a temperature ranging from 200 to 600° C., 240 to 590° C., 270 to 580° C., 300 to 570° C., or 320 to 560° C.

Although not wishing to be bound by theory, depending on the temperature and environmental conditions within the liquification vessel(s), at least a portion of the plastic feed in the liquification vessel(s) may undergo pyrolysis and thereby produce a pyrolysis effluent. More particularly, if temperatures above 350° C. are utilized in the liquification vessel(s), then pyrolytic conditions may be present within the liquification vessel(s). Thus, in such embodiments, the liquefied waste stream formed in the liquification vessel(s) may also undergo a certain amount of pyrolysis and form pyrolysis products (e.g., a pyrolysis gas, a pyrolysis oil, and a pyrolysis residue). Generally, the liquification vessel(s) may operate at higher temperatures that are within pyrolysis temperatures so as to facilitate the downstream pyrolysis and cracking that occurs in the pyrolysis reactor, as described below. Consequently, by utilizing mild pyrolysis conditions within the liquification vessel(s), it has been discovered that downstream cracking can be better achieved in the pyrolysis reactor.

As used herein, the term "pyrolysis" refers to thermal decomposition of a feedstock of a biomass and/or a plastic material in solid or liquid form at elevated temperatures in an inert (i.e., substantially molecular oxygen free) atmosphere.

Generally, the residence times of the plastic feed stream in the liquification vessel(s) can vary depending on the type of the liquification vessel(s). In an embodiment or in combination with any embodiment mentioned herein, the residence times of the plastic feed stream in the liquification vessel(s) can be least 1, at least 2, at least 3, at least 4, at least 5, at least 6, at least 7, at least 8, at least 9, at least 10, at least 20, at least 30, at least 45, at least 60, at least 75, or at least 90 minutes. Additionally, or alternatively, the residence times of the feedstocks within the pyrolysis reactor can be less than 6, less than 5, less than 4, less than 3, less than 2, less than 1, or less than 0.5 hours. Additionally, or alternatively, the residence times of the plastic feed stream in the liquification vessel(s) can be less than 100, less than 90, less than 80, less than 70, less than 60, less than 50, less than 40, less than 30, less than 20, less than 10, less than 9, less than 8, less than 7, less than 6, less than 5, less than 4, less than 3, less than 2, or less than 1 minutes. More particularly, the residence times of the feedstocks within the liquification vessel(s) can range from 30 minutes to 4 hours, 30 minutes to 3 hours, 1 hour to 3 hours, or 1 hour to 2 hours.

In an embodiment or in combination with any embodiment mentioned herein, the liquification vessel(s), such as the melt tank and/or the extruder, may be at least partially heated by an electrical heat source (e.g., one or more electrical heaters) and/or a combustion heat system comprising a plurality a burners that combust a combustion fuel and a combustion air. The combustion fuel may comprise a conventional fossil fuel and/or a recycle content fuel, such as recycle content alkanes (e.g., r-methane) and/or recycle content hydrogen derived from the chemical recycling facility.

In an embodiment or in combination with any embodiment mentioned herein, the liquification system 16 may optionally contain equipment for removing halogens from the waste plastic stream. When the waste plastic is heated in the liquification system 16, halogen enriched gases can evolve. By disengaging the evolved halogen-enriched gasses from the liquified plastics, the concentration of halogens in the liquified plastic stream 18 can be reduced.

In an embodiment or in combination with any embodiment mentioned herein, dehalogenation can be promoted by sparging a stripping gas (e.g., steam) into the liquified plastics in the melt tank.

In an embodiment or in combination with any embodiment mentioned herein, the stream 18 exiting the liquification system 16 can have a halogen content of less than 500, less than 400, less than 300, less than 200, less than 100, less than 50, less than 10, less than 5, less than 2, less than 1, less than 0.5, or less than 0.1 ppmw.

As noted above, the liquification vessel(s) may operate under pyrolytic conditions and, therefore, produce pyrolysis products (e.g., pyrolysis gas, pyrolysis oil, and/or pyrolysis residue). Thus, if pyrolytic temperatures and conditions are utilized in the plastic liquification system, a pyrolysis effluent stream may be recovered from the system.

In an embodiment or in combination with any embodiment mentioned herein, the pyrolysis effluent stream exiting the plastic liquification system may comprise at least 1, at least 5, at least 10, at least 15, at least 20, at least 25, at least 30, at least 35, at least 40, at least 45, at least 50, at least 55, at least 60, at least 65, at least 70, or at least 75 weight percent of one or more pyrolysis products, such as pyrolysis gas, pyrolysis oil, and/or pyrolysis residue. Additionally, or in the alternative, the pyrolysis effluent stream exiting the plastic liquification system may comprise not more than 99, not more than 95, not more than 90, not more than 85, not more than 80, not more than 75, not more than 70, not more than 65, not more than 60, not more than 55, not more than 50, not more than 45, not more than 40, not more than 35, not more than 30, not more than 25, not more than 20, not more than 15, or not more than 10 weight percent of one or more pyrolysis products, such as pyrolysis gas, pyrolysis oil, and/or pyrolysis residue.

In an embodiment or in combination with any embodiment mentioned herein, the pyrolysis effluent stream exiting the plastic liquification system may comprise at least 1, at least 5, at least 10, at least 15, at least 20, at least 25, at least 30, at least 35, at least 40, at least 45, at least 50, at least 55, at least 60, at least 65, at least 70, or at least 75 weight percent of unreacted (i.e., non-pyrolyzed) liquefied plastics. Additionally, or in the alternative, the pyrolysis effluent stream exiting the plastic liquification system may comprise not more than 99, not more than 95, not more than 90, not more than 85, not more than 80, not more than 75, not more than 70, not more than 65, not more than 60, not more than 55, not more than 50, not more than 45, not more than 40, not more than 35, not more than 30, not more than 25, not more than 20, not more than 15, or not more than 10 weight percent of unreacted (i.e., non-pyrolyzed) liquefied plastics.

In an embodiment or in combination with any embodiment mentioned herein, the pyrolysis effluent stream exiting the plastic liquification system may have a temperature of at least 275, at least 300, at least 325, at least 350, at least 375, at least 400, at least 425, at least 450, at least 475, at least 500, at least 525, or at least 550° C. Additionally, or in the alternative, the pyrolysis effluent stream exiting the plastic liquification system may have a temperature of less than 650, less than 625, less than 600, less than 575, or less than 550° C.

As shown in FIG. 1 and described below in greater detail, at least a portion of the pyrolysis effluent stream from the plastic liquification system may be introduced into a downstream pyrolysis reactor 20 at a pyrolysis facility to produce a pyrolysis vapor stream, including additional pyrolysis oil and additional pyrolysis gas.

Figure 2:
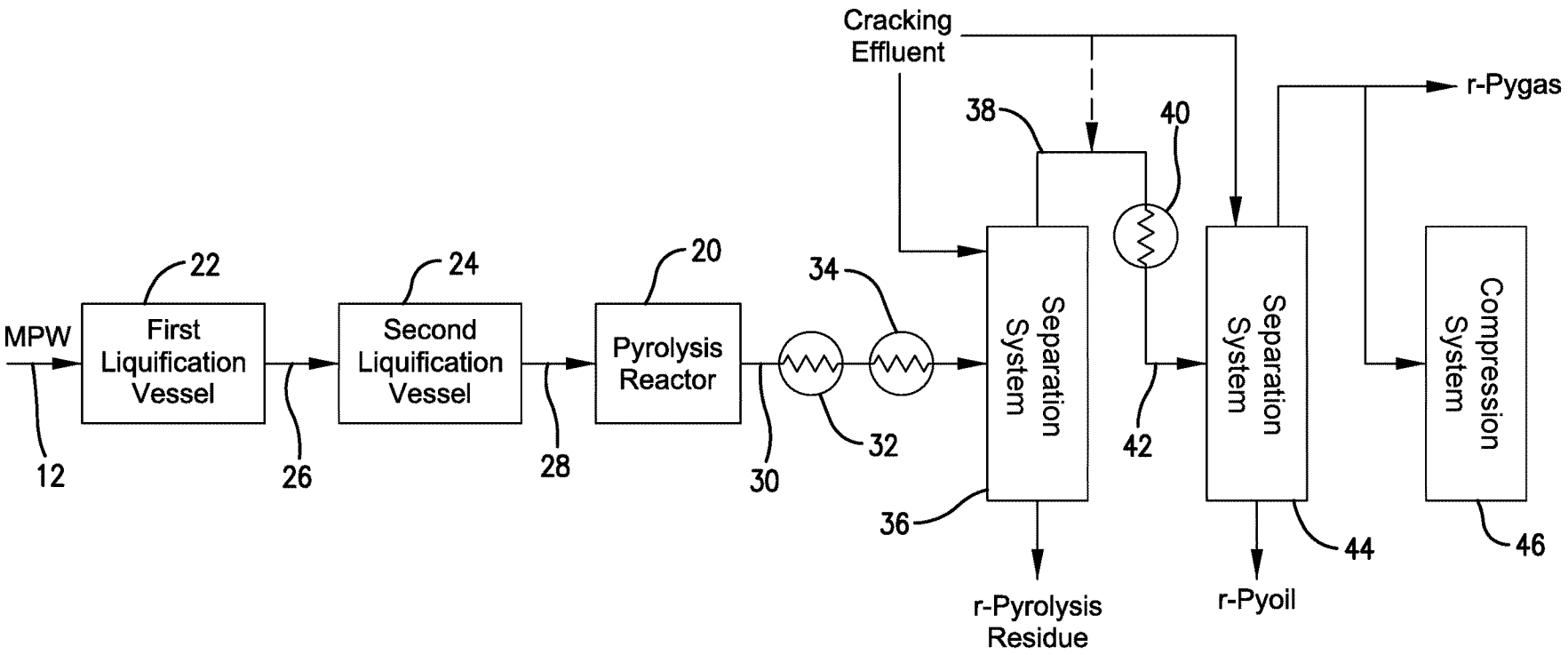
FIG. 2 is a block flow diagram illustrating more specific steps of a process and facility for chemically recycling waste plastic according to embodiments of the present technology.

FIG. 2 depicts an exemplary plastic liquification system 10 comprising a first liquification vessel 22 and a second liquification vessel 24. It should be noted that all of the above operating temperature and conditions disclosed above in regard to the liquification vessel(s) in FIG. 1 are also applicable to the first liquification vessel 22 and the second liquification vessel 24, unless otherwise noted.

In the plastic liquification system depicted in FIG. 2, the waste plastic stream 12 may be introduced into the first liquification vessel 22 so as to at least partially liquefy the solid waste plastics and form a liquefied plastic stream 26. Subsequently, at least a portion of the liquefied plastic stream 26 may be introduced into the second liquification vessel 24 where at least a portion of the liquefied plastic stream may be pyrolyzed to form a pyrolysis effluent stream 28. Thus, in such embodiments, the first liquification vessel 22 may operate at temperatures that are lower than those present in the second liquification vessel 24, but still high enough to melt the solid waste plastics.

In an embodiment or in combination with any embodiment mentioned herein, the interior space of the first liquification vessel 22, where the plastic is liquefied, may be maintained at a temperature of at least 200, at least 210, at least 225, at least 230, at least 240, at least 250, at least 260, at least 270, at least 280, at least 290, or at least 295° C. Additionally, or in the alternative, the interior space of the first liquification vessel 22 may be maintained at a temperature of not more than 400, not more than 390, not more than 375, not more than 360, not more than 350, not more than 345, not more than 340, not more than 335, not more than 330 or not more than 325° C.

In an embodiment or in combination with any embodiment mentioned herein, the liquified plastic stream 26 formed within the first liquification vessel 22 can have a viscosity of less than 3,000, less than 2,500, less than 2,000, less than 1,500, less than 1,000, less than 800, less than 750, less than 700, less than 650, less than 600, less than 550, less than 500, less than 450, less than 400, less than 350, less than 300, less than 250, less than 150, less than 100, less than 75, less than 50, less than 25, less than 10, less than 5, or less than 1 poise, as measured using a Brookfield R/S rheometer with a V80-40 vane spindle operating at a shear rate of 10 rad/s and a temperature of 350° C.

In an embodiment or in combination with any embodiment mentioned herein, the liquefied plastic stream 26 exiting the first liquification vessel 22 may have a temperature of at least 275, at least 280, at least 290, or at least 295° C. Additionally, or in the alternative, the liquefied plastic stream 26 exiting the first liquification vessel 22 may have a temperature of less than 450, less than 425, less than 400, less than 350, or less than 325° C.

Turning back to FIG. 2, at least a portion of the liquefied plastic stream 26 from the first liquification vessel 22 may be introduced into the second liquification vessel 24, where at least portion of the liquefied plastic stream 26 may be subjected to mild pyrolysis conditions (i.e., pyrolysis conditions that are less severe relative to those in the pyrolysis reactor) to produce a pyrolysis effluent stream.

In an embodiment or in combination with any embodiment mentioned herein, the interior space of the second liquification vessel 24 may be maintained at a temperature of at least 350, at least 375, at least 400, at least 425, at least 450, at least 475, at least 500, at least 525, or at least 550° C. Additionally, or in the alternative, the interior space of the second liquification vessel 24 may be maintained at a temperature of not more than 650, not more than 625, not more than 600, or not more than 575° C.

In an embodiment or in combination with any embodiment mentioned herein, the pyrolysis effluent stream 28 exiting the second liquification vessel 24 may have a temperature of at least 350, at least 375, at least 400, at least 425, at least 450, at least 475, at least 500, at least 525, or at least 550° C. Additionally, or in the alternative, the pyrolysis effluent stream 28 exiting the second liquification vessel 24 may have a temperature of not more than 650, not more than 625, not more than 600, or not more than 575° C.

It should be noted that the first liquification vessel 22 and the second liquification vessel 24 may include any heated vessel, such as the melt tanks described herein. The first liquification vessel 22 and the second liquification vessel 24 may be at least partially heated by an electrical heat source (e.g., one or more electrical heaters) and/or a combustion heat system comprising a plurality a burners that combust a combustion fuel and a combustion air. In certain embodiments, the first liquification vessel 22 and the second liquification vessel 24 may be heated via separate heated devices. Alternatively, the first liquification vessel 22 and the second liquification vessel 24 may be heated with a common heat source (e.g., one or more electrical heat sources).

The pyrolysis effluent stream 28 produced in accordance with the system depicted in FIG. 2 can have the same compositional ranges as discussed above regarding the pyrolysis effluent stream produced in accordance with FIG. 1.

As shown in FIG. 2 and described below in greater detail, at least a portion of the pyrolysis effluent stream from the plastic liquification system may be introduced into a downstream pyrolysis reactor 20 at a pyrolysis facility to produce a pyrolysis vapor stream 30, including additional pyrolysis oil and additional pyrolysis gas.

Pyrolysis

As shown in FIGS. 1 and 2, the chemical recycling facility may comprise a pyrolysis reactor 20. A "pyrolysis facility" is a facility that includes all equipment, lines, and controls necessary to carry out pyrolysis of waste plastic and feedstocks derived therefrom. In certain embodiments, the pyrolysis facility can comprise the pyrolysis reactor 20 and, optionally, the plastic liquification system 16.

As depicted in FIGS. 1 and 2, at least a portion of the pyrolysis effluent stream 18, 28 from the plastic liquification system 16 may be introduced into a downstream pyrolysis reactor 20 at a pyrolysis facility so as to produce a pyrolysis vapor stream 30 comprising a pyrolysis oil, a pyrolysis gas, and a pyrolysis residue.

In an embodiment or in combination with any embodiment mentioned herein, the pyrolysis effluent stream 28 to the pyrolysis facility may be a PO-enriched stream of waste plastic. As noted above, the pyrolysis effluent stream 28 introduced into the pyrolysis reactor 20 can still contain varying amounts of unreacted (i.e., non-pyrolyzed) liquified plastic (e.g., liquified, melted, plasticized, depolymerized, or combinations thereof), plastic pellets or particulates, or a slurry thereof.

In general, the pyrolysis facility may include the plastic liquification system 16, the pyrolysis reactor 20, and separation systems for the pyrolysis vapors, which can separate the pyrolysis vapors into a pyrolysis gas stream, a pyrolysis oil stream, and/or a pyrolysis residue stream.

While in the pyrolysis reactor 20, at least a portion of the feed may be subjected to a pyrolysis reaction that produces a pyrolysis vapor stream 30 comprising a pyrolysis oil, a pyrolysis gas, and a pyrolysis residue. Generally, the pyrolysis vapor stream 30 exiting the pyrolysis reactor 20 can be in the form of vapors that comprise the pyrolysis gas and uncondensed pyrolysis oil. As used herein, "pyrolysis vapor" refers to the uncondensed pyrolysis effluent.

Pyrolysis is a process that involves the chemical and thermal decomposition of the introduced feed. Although all pyrolysis processes may be generally characterized by a reaction environment that is substantially free of oxygen, pyrolysis processes may be further defined, for example, by the pyrolysis reaction temperature within the reactor, the residence time in the pyrolysis reactor, the reactor type, the pressure within the pyrolysis reactor, and the presence or absence of pyrolysis catalysts.

In an embodiment or in combination with any embodiment mentioned herein, the pyrolysis reactor 20 can be, for example, a film reactor, a screw extruder, a tubular reactor, a tank, a stirred tank reactor, a riser reactor, a fixed bed reactor, a fluidized bed reactor, a rotary kiln, a vacuum reactor, a microwave reactor, or an autoclave.

In an embodiment or in combination with any embodiment mentioned herein, a lift gas and/or a feed gas may be used to introduce the feedstock into the pyrolysis reactor 20 and/or facilitate various reactions within the pyrolysis reactor 20. For instance, the lift gas and/or the feed gas may comprise, consist essentially of, or consist of nitrogen, carbon dioxide, and/or steam. The lift gas and/or feed gas may be added with the waste plastic stream prior to introduction into the pyrolysis reactor 20 and/or may be added directly to the pyrolysis reactor 20. The lift gas and/or feed gas can include steam and/or a reducing gas such as hydrogen, carbon monoxide, and combinations thereof.

In an embodiment or in combination with any embodiment mentioned herein, the lift gas and/or the feed gas may comprise steam. For example, the steam may be fed into the pyrolysis reactor at a steam to hydrocarbon ratio of at least 0.1, at least 0.2, at least 0.3, or at least 0.4 and/or not more than 1.0. Alternatively, in certain embodiments, no steam is added to the pyrolysis reactor.

Furthermore, the temperature in the pyrolysis reactor 20 can be adjusted so as to facilitate the production of certain end products. In an embodiment or in combination with any embodiment mentioned herein, the pyrolysis temperature in the pyrolysis reactor 20 can be at least 500, at least 550, at least 600, at least 625, at least 650, at least 675, at least 700, at least 725, or at least 750° C. Additionally, or in the alternative, the pyrolysis temperature in the pyrolysis reactor 20 can be not more than 1,200, 1,100, 1,000, 900, or 800° C.

In an embodiment or in combination with any embodiment mentioned herein, the pyrolysis temperature in the pyrolysis reactor 20 can range from 500 to 1,100° C., 500 to 800° C., 600 to 1,100° C., 600 to 800° C., 650 to 1,000° C., 700 to 1,000° C., or 650 to 800° C. Generally, in certain embodiments, the pyrolysis temperature in the pyrolysis reactor 20 can be greater than 650° C.

In an embodiment or in combination with any embodiment mentioned herein, the residence times of the feedstocks within the pyrolysis reactor 20 can be at least 0.1, at least 0.2, at least 0.3, at least 0.5, at least 1, at least 1.2, at least 1.3, at least 2, at least 3, or at least 4 seconds. Alternatively, the residence times of the feedstocks within the pyrolysis reactor 20 can be at least 1, at least 2, at least 3, at least 4, at least 5, at least 6, at least 7, at least 8, at least 9, at least 10, at least 20, at least 30, at least 45, at least 60, at least 75, or at least 90 minutes. Additionally, or alternatively, the residence times of the feedstocks within the pyrolysis reactor 20 can be less than 6, less than 5, less than 4, less than 3, less than 2, less than 1, or less than 0.5 hours. Furthermore, the residence times of the feedstocks within the pyrolysis reactor 20 can be less than 100, less than 90, less than 80, less than 70, less than 60, less than 50, less than 40, less than 30, less than 20, less than 10, less than 9, less than 8, less than 7, less than 6, less than 5, less than 4, less than 3, less than 2, or less than 1 seconds. More particularly, the residence times of the feedstocks within the pyrolysis reactor 20 can range from 0.1 to 10 seconds, 0.5 to 10 seconds, 30 minutes to 4 hours, or 30 minutes to 3 hours, or 1 hour to 3 hours, or 1 hour to 2 hours.

In an embodiment or in combination with any embodiment mentioned herein, the pressure within the pyrolysis reactor 20 can be maintained at atmospheric pressure or within the range of 0.1 to 100 bar, or 0.1 to 60 bar, or 0.1 to 30 bar, or 0.1 to 10 bar, 0.2 to 1.5 bar, or 0.3 to 1.1 bar. As used herein, the term "bar" refers to gauge pressure, unless otherwise noted.

In an embodiment or in combination with any embodiment mentioned herein, a pyrolysis catalyst may be introduced into the liquified plastic stream prior to introduction into the pyrolysis reactor 20 and/or introduced directly into the pyrolysis reactor 20. The catalyst can be homogenous or heterogeneous and may include, for example, certain types of zeolites and other mesostructured catalysts.

In an embodiment or in combination with any embodiment mentioned herein, the pyrolysis reaction may not be catalyzed (e.g., carried out in the absence of a pyrolysis catalyst), but may include a non-catalytic, heat-retaining inert additive, such as sand, in the reactor in order to facilitate the heat transfer. Such catalyst-free pyrolysis processes may be referred to as "thermal pyrolysis."

In an embodiment or in combination with any embodiment mentioned herein, the pyrolysis reactor 20 may be at least partially heated by an electrical heat source (e.g., one or more electrical heaters) and/or a combustion heat system comprising a plurality a burners that combust a combustion fuel and a combustion air. The combustion fuel may comprise a conventional fossil fuel and/or a recycle content fuel, such as recycle content alkanes (e.g., r-methane) and/or recycle content hydrogen derived from the chemical recycling facility.

In an embodiment or in combination with any embodiment mentioned herein, the pyrolysis vapor stream 30 from the pyrolysis reactor 20 may comprise at least 1, at least 5, at least 10, at least 15, at least 20, at least 25, at least 30, at least 35, at least 40, at least 45, at least 50, at least 55, at least 60, at least 65, at least 70, or at least 75 weight percent of the pyrolysis oil, based on the total weight of the pyrolysis vapor stream. Additionally, or alternatively, the pyrolysis vapor stream 30 may comprise not more than 99, not more than 95, not more than 90, not more than 85, not more than 80, not more than 75, not more than 70, not more than 65, not more than 60, not more than 55, not more than 50, not more than 45, not more than 40, not more than 35, not more than 30, or not more than 25 weight percent of the pyrolysis oil, based on the total weight of the pyrolysis vapor stream. As discussed above, the pyrolysis oil may be in the form of uncondensed vapors in the pyrolysis vapor stream 30 upon exiting the heated reactor; however, these vapors may be subsequently condensed into the resulting pyrolysis oil. The pyrolysis vapor stream 30 may comprise in the range of 20 to 99 weight percent, 25 to 80 weight percent, 30 to 85 weight percent, 30 to 80 weight percent, 30 to 75 weight percent, 30 to 70 weight percent, or 30 to 65 weight percent of the pyrolysis oil, based on the total weight of the pyrolysis vapor stream.

In an embodiment or in combination with any embodiment mentioned herein, the pyrolysis vapor stream 30 from the pyrolysis reactor 20 may comprise at least 1, at least 5, at least 10, at least 15, at least 20, at least 25, at least 30, at least 35, at least 40, at least 45, at least 50, at least 55, at least 60, at least 65, at least 70, at least 75, or at least 80 weight percent of the pyrolysis gas, based on the total weight of the pyrolysis vapor stream. Additionally, or alternatively, the pyrolysis vapor stream 30 may comprise not more than 99, not more than 95, not more than 90, not more than 85, not more than 80, not more than 75, not more than 70, not more than 65, not more than 60, not more than 55, not more than 50, or not more than 45 weight percent of the pyrolysis gas, based on the total weight of the pyrolysis vapor stream. The pyrolysis vapor stream 30 may comprise 1 to 90 weight percent, 10 to 85 weight percent, 15 to 85 weight percent, 20 to 80 weight percent, 25 to 80 weight percent, 30 to 75 weight percent, or 35 to 75 weight percent of the pyrolysis gas, based on the total weight of the stream.

In an embodiment or in combination with any embodiment mentioned herein, the pyrolysis vapor stream 30 from the pyrolysis reactor 20 may comprise at least 0.5, at least 1, at least 2, at least 3, at least 4, at least 5, at least 6, at least 7, at least 8, at least 9, or at least 10 weight percent of the pyrolysis residue, based on the total weight of the pyrolysis vapor stream. Additionally, or alternatively, the pyrolysis vapor stream 30 may comprise not more than 60, not more than 50, not more than 40, not more than 30, not more than 25, not more than 20, not more than 15, not more than 10, not more than 9, not more than 8, not more than 7, not more than 6, or not more than 5 weight percent of the pyrolysis residue, based on the total weight of the pyrolysis vapor stream. The pyrolysis vapor stream 30 may comprise in the range of 0.1 to 25 weight percent, 1 to 15 weight percent, 1 to 8 weight percent, or 1 to 5 weight percent of the pyrolysis residue, based on the total weight of the pyrolysis vapor stream.

Although not wishing to be bound by theory, it is believed that the pyrolysis reactor 20 may produce more cracked products due to the more severe conditions utilized in the reactor. Thus, in various embodiments, the pyrolysis vapor stream 30 may comprise a compositional portfolio that reflects an effluent stream from a cracker furnace in a cracking facility. Therefore, in such embodiments, the pyrolysis vapor stream 30 does not require further processing in a cracking facility, such as in a downstream cracker reactor. Accordingly, the chemical recycling facility may not have a cracking facility, including a cracker furnace.

In an embodiment or in combination with any embodiment mentioned herein, the pyrolysis vapor stream 30 from the pyrolysis reactor 20 may comprise at least 10, at least 11, at least 12, at least 13, at least 14, at least 15, at least 16, at least 17, at least 18, at least 19, at least 20, at least 21, at least 22, at least 23, at least 24, at least 25, at least 26, at least 27, at least 28, or at least 29 weight percent of recycle content ethylene, based on the total weight of the pyrolysis vapor stream. Additionally, or in the alternative, the pyrolysis vapor stream 30 from the pyrolysis reactor 20 may comprise not more than 50, not more than 40, not more than 35 weight percent of recycle content ethylene, based on the total weight of the pyrolysis vapor stream. These weight percentages are measured on a dry-basis.

In an embodiment or in combination with any embodiment mentioned herein, the pyrolysis vapor stream 30 from the pyrolysis reactor 20 may comprise at least 10, at least 11, at least 12, at least 13, at least 14, at least 15, at least 16, at least 17, at least 18, at least 19, or at least 20 weight percent of recycle content propylene, based on the total weight of the pyrolysis vapor stream. Additionally, or in the alternative, the pyrolysis vapor stream 30 from the pyrolysis reactor 22 may comprise not more than 50, not more than 40, not more than 35, not more than 30 weight percent of recycle content propylene, based on the total weight of the pyrolysis vapor stream. These weight percentages are measured on a dry-basis.

In an embodiment or in combination with any embodiment mentioned herein, the pyrolysis vapor stream 30 from the pyrolysis reactor 20 may comprise at least 3, at least 4, at least 5, at least 6, or at least 7 weight percent of recycle content methane, based on the total weight of the pyrolysis vapor stream. Additionally, or in the alternative, the pyrolysis vapor stream 30 from the pyrolysis reactor 20 may comprise not more than 25, not more than 20, not more than 15, or not more than 10 weight percent of recycle content methane, based on the total weight of the pyrolysis vapor stream. These weight percentages are measured on a dry-basis.

In an embodiment or in combination with any embodiment mentioned herein, the pyrolysis vapor stream 30 from the pyrolysis reactor 20 may comprise at least 1, at least 2, at least 3 or at least 4 weight percent of recycle content butylenes, based on the total weight of the pyrolysis vapor stream. Additionally, or in the alternative, the pyrolysis vapor stream 30 from the pyrolysis reactor 20 may comprise less than 10, less than 9, less than 8, less than 7, or less than 6 weight percent of recycle content butylenes, based on the total weight of the pyrolysis vapor stream. These weight percentages are measured on a dry-basis.

In an embodiment or in combination with any embodiment mentioned herein, the pyrolysis vapor stream 30 from the pyrolysis reactor 20 may comprise at least 0.1 or at least 0.5 weight percent of C6-C9 hydrocarbons, based on the total weight of the pyrolysis vapor stream. Additionally, or in the alternative, the pyrolysis vapor stream 30 from the pyrolysis reactor 20 may comprise less than 10, less than 9, less than 8, less than 7, less than 6, less than 5, less than 4, less than 3, or less than 2 weight percent of C6-C9 hydrocarbons, based on the total weight of the pyrolysis vapor stream. These weight percentages are measured on a dry-basis.

In an embodiment or in combination with any embodiment mentioned herein, the pyrolysis vapor stream 30 from the pyrolysis reactor 20 may comprise at least 0.1 or at least 0.5 weight percent of C10-C25 hydrocarbons, based on the total weight of the pyrolysis vapor stream. Additionally, or in the alternative, the pyrolysis vapor stream 30 from the pyrolysis reactor 20 may comprise less than 15, less than 10, less than 9, less than 8, less than 7, less than 6, less than 5, less than 4, less than 3, less than 2, less than 1 weight percent of C10-C25 hydrocarbons, based on the total weight of the pyrolysis vapor stream. These weight percentages are measured on a dry-basis.

As discussed below in greater detail, after exiting the pyrolysis reactor 20, the pyrolysis vapor stream 30 may be separated into a recycle content pyrolysis oil stream, a recycle content pyrolysis residue stream, and a recycle content pyrolysis gas stream in a separation system.

Heat Transfer and Separation

As shown in FIGS. 1 and 2, prior to being introduced into the first separation system 36, at least a portion of the pyrolysis vapor stream 30 may be cooled via indirect heat exchange with at least one heat transfer medium (HTM) in a first heat exchanger 32 and/or a second heat exchanger 34. More particularly, the heat transfer medium may recover heat energy from at least a portion of the pyrolysis vapor stream via the heat exchangers. While in these heat exchangers, the heat transfer medium can recover at least a portion of the heat energy from the pyrolysis vapor stream 30 via indirect heat exchange.

The heat exchangers 32, 34 can comprise any conventional cross-flow heat exchangers known in the art, such as a transfer line exchanger. In certain embodiments, the heat exchangers may comprise a brazed aluminum heat exchanger comprising a plurality of cooling and warming passes (e.g., cores) disposed therein for facilitating indirect heat exchange between one or more process streams and at least one heat transfer medium stream. Although generally illustrated in FIGS. 1 and 2 as comprising a single core or "shell," it should be understood that the heat exchangers can comprise two or more separate core or shells.

After indirect heat exchange with the pyrolysis vapors stream 30 in the first heat exchanger 32 and/or the second heat exchanger 34, the temperature of the heat transfer medium can increase by at least 25, at least 50, at least 75, at least 100, at least 125, at least 150, at least 175, or at least 200° C. and/or not more than 400, not more than 350, not more than 300, or not more than 250° C.

Additionally, or in the alternative, after indirect heat exchange with the heat transfer medium in the first heat exchanger 32 and/or the second heat exchanger 34, the temperature of the pyrolysis vapor stream 30 can decrease by at least 25, at least 50, at least 75, at least 100, at least 125, at least 150, at least 175, or at least 200° C. and/or not more than 400, not more than 350, not more than 300, or not more than 250° C.

The heat transfer medium can be any conventional heat transfer medium known in the art. In an embodiment or in combination with any embodiment mentioned herein, the heat transfer medium can be a non-aqueous fluid or an aqueous fluid (e.g., water and/or steam). The heat transfer medium may also be a single-phase medium (e.g., liquid or vapor) or a two-phase medium (e.g., liquid/vapor). In certain embodiments, the heat transfer medium may be in a liquid phase prior to heating (e.g., water) and then transition to another phase (e.g., steam) or a mixed phase (e.g., water/steam) upon heating.

Examples of suitable non-aqueous heat transfer media that can be used as the heat transfer medium includes an oil, a siloxane, a molten metal, a molten salt, or a combination thereof.

In an embodiment or in combination with any embodiment mentioned herein, the heat transfer medium comprises a non-aqueous heat transfer medium, such as a synthetic oil (e.g., THERMINOL®), a refined oil (e.g., a mineral oil), or a combination thereof. As used herein, a "refined oil" refers to a natural (i.e., non-synthetic) oil that has been subjected to a distillation and/or or purification step.

In an embodiment or in combination with any embodiment mentioned herein, the heat transfer medium comprises a molten salt. Exemplary molten salts include sodium chloride, sodium nitrate, potassium nitrate, or a combination thereof.

In an embodiment or in combination with any embodiment mentioned herein, the heat transfer medium comprises a molten metal. Exemplary molten metals can include lithium, gallium, sodium, cadmium, potassium, indium, lead, tin, bismuth, thallium, or a combination thereof.

In an embodiment or in combination with any embodiment mentioned herein, the heat transfer medium comprises an aqueous fluid, such as steam and/or water.

In an embodiment or in combination with any embodiment mentioned herein, the heat transfer medium comprises steam. The steam can comprise a pressure of at least 700, at least 800, at least 900, at least 1,000, at least 1,100, at least 1,200, at least 1,300, at least 1,400, at least 1,500, or at least 1590 psi and/or less than 2,000, less than 1,800, less than 1,700, or less than 1,650 psi. In certain embodiments, the steam can comprise 1,600 psi steam.

Turning again to FIGS. 1 and 2, after exiting the first heat exchanger 32 and/or the second heat exchanger 34, the cooled pyrolysis vapor stream may be subjected to separation in a first separation system 36.

Although not depicted in FIGS. 1 and 2, this first separation system 36 can include various types of equipment including, but not limited to a filter system, a multistage separator, a condensation zone, a distillation column, and/or a quench tower. While in the first separation system 36, at least a portion of the pyrolysis residue present in the pyrolysis vapor stream may be recovered so as to form a recycle content pyrolysis residue stream and a light pyrolysis vapor stream 38. As used herein, a "light pyrolysis vapor stream" refers to a pyrolysis vapor stream that has had at least a portion of the pyrolysis residue removed therefrom.

In an embodiment or in combination with any embodiment mentioned herein, as shown in FIGS. 1 and 2, a cracking effluent from a cracking facility may be co-fed into the first separation system 36 with at least a portion of the pyrolysis vapor stream. This cracking effluent stream may come from a cracking facility that is co-located with the pyrolysis facility and/or may come from a cracking facility that is remotely located from the pyrolysis facility. The cracking effluent stream may also be a recycle content cracking effluent stream that has been directly or indirectly derived from waste plastics.

After exiting the first separation system 36, at least a portion of the light pyrolysis vapor stream 38 may be further cooled in a third heat exchanger 40 via indirect heat exchange with a heat transfer medium. The heat exchanger 40 can comprise any conventional cross-flow heat exchangers known in the art, such as a transfer line exchanger. In certain embodiments, the heat exchangers 40 may comprise a brazed aluminum heat exchanger comprising a plurality of cooling and warming passes (e.g., cores) disposed therein for facilitating indirect heat exchange between one or more process streams and at least one heat transfer medium stream. Although generally illustrated in FIGS. 1 and 2 as comprising a single core or "shell," it should be understood that the heat exchanger can comprise two or more separate core or shells.

After indirect heat exchange with the light pyrolysis vapors stream 38 in the third heat exchanger 40, the temperature of the heat transfer medium can increase by at least 10, at least 25, at least 50, at least 75, at least 100, at least 125, at least 150, at least 175, or at least 200° C. and/or not more than 400, not more than 350, not more than 300, or not more than 250° C.

Additionally, or in the alternative, after indirect heat exchange with the heat transfer medium in the third heat exchanger 40, the temperature of the light pyrolysis vapor stream 38 can decrease by at least 10, at least 25, at least 50, at least 75, at least 100, at least 125, at least 150, at least 175, or at least 200° C. and/or not more than 400, not more than 350, not more than 300, or not more than 250° C.

The heat transfer medium used with the third heat exchanger 40 can be any of the heat transfer media previously disclosed above in regard to the first heat exchanger 32 and the second heat exchanger 34.

After exiting the third heat exchanger 40, at least a portion of the cooled light pyrolysis vapor stream 42 may be introduced into a second separation system 44 to separate the light pyrolysis vapor stream into a recycle content pyrolysis oil stream (r-pyoil) and a recycle content pyrolysis gas stream (r-pygas). Although not depicted in FIGS. 1 and 2, this second separation system 44 can include various types of equipment including, but not limited to a filter system, a multistage separator, a condensation zone, a distillation column, and/or a quench tower. While in the second separation system 44, at least a portion of the light pyrolysis vapor stream may be separated so as to form a recycle content pyrolysis oil stream and a pyrolysis gas stream.

In an embodiment or in combination with any embodiment mentioned herein, the first separation system 36 and/or the second separation system 44 may comprise a quench tower. While in the quench tower, at least a portion of the pyrolysis vapor stream and/or the light pyrolysis vapor stream, optionally in the presence of a cracking effluent, may be cooled rapidly (e.g., quenched) in order to prevent production of large amounts of undesirable by-products and to minimize fouling in downstream equipment.

In an embodiment or in combination with any of the embodiments mentioned herein, the temperature of the pyrolysis vapor stream and/or the light pyrolysis vapor stream, along with the optional cracking effluent, can be reduced in the quench tower by 35 to 485° C., 35 to 375° C., or 90 to 550° C. The cooling step may be performed immediately after the pyrolysis vapor stream leaves the pyrolysis reactor such as, for example, within 1 to 90, 5 to 80, or 5 to 70 milliseconds.

In an embodiment or in combination with any of the embodiments mentioned herein, the quenching step in the quench tower may be performed via indirect heat exchange with high-pressure water or steam in a heat exchanger (e.g., a transfer line exchanger), while, in other embodiments, the quench step may be carried out by directly contacting the treated streams with a quench liquid. The temperature of the quench liquid can be at least 20° C., at least 35° C., at least 50° C., at least 65° C., at least 80° C., at least 90° C., or at least 100° C. and/or not more than 350° C., not more than 325° C., not more than 300° C., not more than 250° C., not more than 210° C., not more than 180° C., not more than 165° C., not more than 150° C., or not more than 135° C. When a quench liquid is used, the contacting may occur in a quench tower and a liquid stream may be removed from the quench tower comprising gasoline and other similar boiling-range hydrocarbon components. Generally, the quench liquid can comprise water, an oil, or a combination thereof. An exemplary quench tower configuration is disclosed in U.S. Pat. No. 7,972,482.

In an embodiment or in combination with any embodiment mentioned herein, as shown in FIGS. 1 and 2, a cracking effluent from a cracking facility may be co-fed into the second separation system 44 with at least a portion of the light pyrolysis vapor stream. The cracking effluent may be fed separately into the second separation system 44 or combined with the light pyrolysis vapor stream before the second separation system 44. This cracking effluent stream may come from a cracking facility that is co-located with the pyrolysis facility and/or may come from a cracking facility that is remotely located from the pyrolysis facility. The cracking effluent stream may also be a recycle content cracking effluent stream that has been directly or indirectly derived from waste plastics.

The resulting pyrolysis oil stream and pyrolysis gas stream may be directly used in various downstream applications based on their formulations. The various characteristics and properties of the pyrolysis oil stream, pyrolysis gas stream, and pyrolysis residue stream are described below. It should be noted that, while all of the following characteristics and properties may be listed separately, it is envisioned that each of the following characteristics and/or properties of the pyrolysis oil stream, pyrolysis gas stream, and pyrolysis residue stream are not mutually exclusive and may be combined and present in any combination.

In an embodiment or in combination with any embodiment mentioned herein, the pyrolysis oil stream may predominantly comprise hydrocarbons having from 4 to 30 carbon atoms per molecule (e.g., C4 to C30 hydrocarbons). As used herein, the term "Cx" or "Cx hydrocarbon," refers to a hydrocarbon compound including "x" total carbons per molecule, and encompasses all olefins, paraffins, aromatics, heterocyclic, and isomers having that number of carbon atoms. For example, each of normal, iso, and tert-butane and butene and butadiene molecules would fall under the general description "C4." The pyrolysis oil stream may have a C4-C30 hydrocarbon content of at least 55, at least 60, at least 65, at least 70, at least 75, at least 80, at least 85, at least 90, or at least 95 weight percent based on the total weight of the pyrolysis oil stream.

In an embodiment or in combination with any embodiment mentioned herein, the pyrolysis oil stream can predominantly comprise C5 to C25 hydrocarbons, C5 to C22 hydrocarbons, or C5 to C20 hydrocarbons. For example, the pyrolysis oil stream may comprise at least 55, at least 60, at least 65, at least 70, at least 75, at least 80, at least 85, at least 90, or at least 95 weight percent of C5 to C25 hydrocarbons, C5 to C22 hydrocarbons, or C5 to C20 hydrocarbons, based on the total weight of the pyrolysis oil stream.

In an embodiment or in combination with any embodiment mentioned herein, the pyrolysis oil stream may have a mid-boiling point in the range of 75 to 250° C., 90 to 225° C., or 115 to 190° C. as measured according to ASTM D-5399. As used herein, "mid-boiling point" refers to the median boiling point temperature of the pyrolysis oil stream, where 50 percent by volume of the pyrolysis oil boils above the mid-boiling point and 50 percent by volume boils below the mid-boiling point.

In an embodiment or in combination with any embodiment mentioned herein, the boiling point range of the pyrolysis oil stream may be such that at least 90 percent of the pyrolysis oil boils off at a temperature of 250° C., of 280° C., of 290° C., of 300° C., or of 310° C., as measured according to ASTM D-5399.

As noted above, the pyrolysis conditions, such as temperature, may be controlled so as to maximize the production of certain hydrocarbons and chemical compounds in the resulting pyrolysis gas and pyrolysis oil.

Turning to the pyrolysis gas stream, the pyrolysis gas stream can have a methane content in the range of 1 to 50 weight percent, 5 to 50 weight percent, or 15 to 45 weight percent, based on the total weight of the pyrolysis gas stream.

In an embodiment or in combination with any embodiment mentioned herein, the pyrolysis gas stream can have a C3 and/or C4 hydrocarbon content (including all hydrocarbons having 3 or 4 carbon atoms per molecule) in the range of 10 to 90 weight percent, 25 to 90 weight percent, or 25 to 80 weight percent, based on the total weight of the pyrolysis gas stream.

In an embodiment or in combination with any embodiment mentioned herein, the pyrolysis gas stream can have a combined ethylene and propylene content of at least 25, at least 40, at least 50, at least 60, at least 70, or at least 75 weight percent, based on the total weight of the pyrolysis gas stream.

Turning to the pyrolysis residue, in an embodiment or in combination with any embodiment mentioned herein, the pyrolysis residue stream comprises at least 20, at least 25, at least 30, at least 35, at least 40, at least 45, at least 50, at least 55, at least 60, at least 65, at least 70, at least 75, at least 80, or at least 85 weight percent of C20+ hydrocarbons based on the total weight of the pyrolysis residue. As used herein, "C20+ hydrocarbon" refers to hydrocarbon compounds containing at least 20 total carbons per molecule, and encompasses all olefins, paraffins, and isomers having that number of carbon atoms.

At least a portion of the pyrolysis vapor stream, such as the recycle content pyrolysis gas stream, the recycle content pyrolysis oil steam, and/or the recycle content pyrolysis residue stream, may be routed to one or more other chemical processing facilities.

As shown in FIGS. 1 and 2, at least a portion of the pyrolysis vapor stream, such as the recycle content pyrolysis gas stream and/or recycle content pyrolysis oil stream, may be routed to a compression system 46 comprising at least one compressor with one or more stages. In certain embodiments, when the compression system 46 comprises multiple compressors, all or a portion of the pyrolysis gas stream may be introduced prior to and/or after one or more stages of the second compressor.

In an embodiment or in combination with any embodiment mentioned herein, the pyrolysis vapor feed at or into the compression system 46 may be co-fed with a cracking effluent, such as a steam cracker furnace effluent. The pyrolysis vapor feed to the compression system 46 can have a temperature that is not more than 50 percent, not more than 40 percent, not more than 30 percent, not more than 25 percent, not more than 20 percent, not more than 15 percent, not more than 10 percent, not more than 5 percent, not more than 3 percent, or not more than 2 percent of the temperature of the cracking effluent (e.g., a stream cracker furnace effluent) fed to the compression system 46.

In an embodiment or in combination with any embodiment mentioned herein, the feed at or into the compression system 46 may have a temperature of at least 25, at least 30, at least 35, at least 40, at least 45, at least 50, at least 55, at least 60, or at least 65° C. and/or not more than 100, not more than 90, not more than 80, not more than 70° C. As previously discussed, the feed into the compression system 46 may comprise at least a portion of the pyrolysis vapor stream (e.g., including the recycle content pyrolysis gas stream and/or recycle content pyrolysis oil) and, optionally, a cracking effluent stream from a cracking facility.

The compression system 46 may comprise a gas compressor having, for example, between 1 and 5 compression stages with optional inter-stage cooling and liquid removal. The pressure of the gas stream at the outlet of the first set of compression stages may be in the range of from 7 to 20 bar gauge (barg), 8.5 to 18 barg, or 9.5 to 14 barg. The resulting compressed stream may then be treated for removal of acid gases, including halogens, CO, $CO_2$, and $H_2S$ by contact with an acid gas removal agent. Examples of acid gas removal agents can include, but are not limited to, caustic and various types of amines.

The treated compressed stream may then be further compressed in another compressor, optionally with inter-stage cooling and liquid separation. The resulting compressed stream may have a pressure in the range of 20 to 50 barg, 25 to 45 barg, or 30 to 40 barg. Any suitable moisture removal method can be used including, for example, molecular sieves or other similar process.

In an embodiment or in combination with any embodiment mentioned herein, at least a portion of the pyrolysis vapor stream may forego separation in the first separation system 36 and/or the second separation system 44 and be introduced directly into the compression system 46. In such embodiments, all or at least a portion of the pyrolysis vapor stream may forego separation in the separation systems and be directly introduced into any one of the compressors and stages within the compression system 46. Although not wishing to be bound by theory, it is believed that the pyrolysis vapor stream may be directly introduced into the compression system 46 when the pyrolysis reactor operates at "cracking" conditions that are able to at least partially crack the feedstock within the pyrolysis reactor, thereby forming a pyrolysis vapor stream with a high amount of cracked products.

In an embodiment or in combination with any embodiment mentioned herein, the first separation system 36, the second separation system 44, and/or the compression system 46 depicted in FIGS. 1 and 2 can be located in a cracking facility that is co-located with the pyrolysis facility. In such embodiments, the pyrolysis facility may be in fluid communication with the cracking facility. However, even if the pyrolysis facility is in fluid communication with a cracking facility, a cracking reactor (e.g., a cracking furnace) may not be located downstream of the pyrolysis reactor since the pyrolysis effluent does not require any further cracking. Rather, the pyrolysis effluent can utilize the existing separation systems and/or compression systems already present in the cracking facility.

In an embodiment or in combination with any embodiment mentioned herein, the first separation system 36, the second separation system 44, and/or the compression system 46 depicted in FIGS. 1 and 2 are not located in a cracking facility and/or are not in fluid communication with a cracking effluent stream from a cracking facility.

In an alternative embodiment not shown in FIGS. 1 and 2, the compression system 46 may be omitted and at least a portion of the cooled light pyrolysis vapor stream is separated in the second separation system 44 into a recycle content pyrolysis oil stream, a recycle content ethylene stream, and a recycle content propylene stream. In such embodiments, the second separation system 44 may comprise a fractionation section, wherein the recycle content olefins and other components may be recovered from the pyrolysis vapor stream. As used herein, the term "fractionation" refers to the general process of separating two or more materials having different boiling points. Examples of equipment and processes that utilize fractionation include, but are not limited to, distillation, rectification, stripping, and vapor-liquid separation (single stage).

Figure 3:
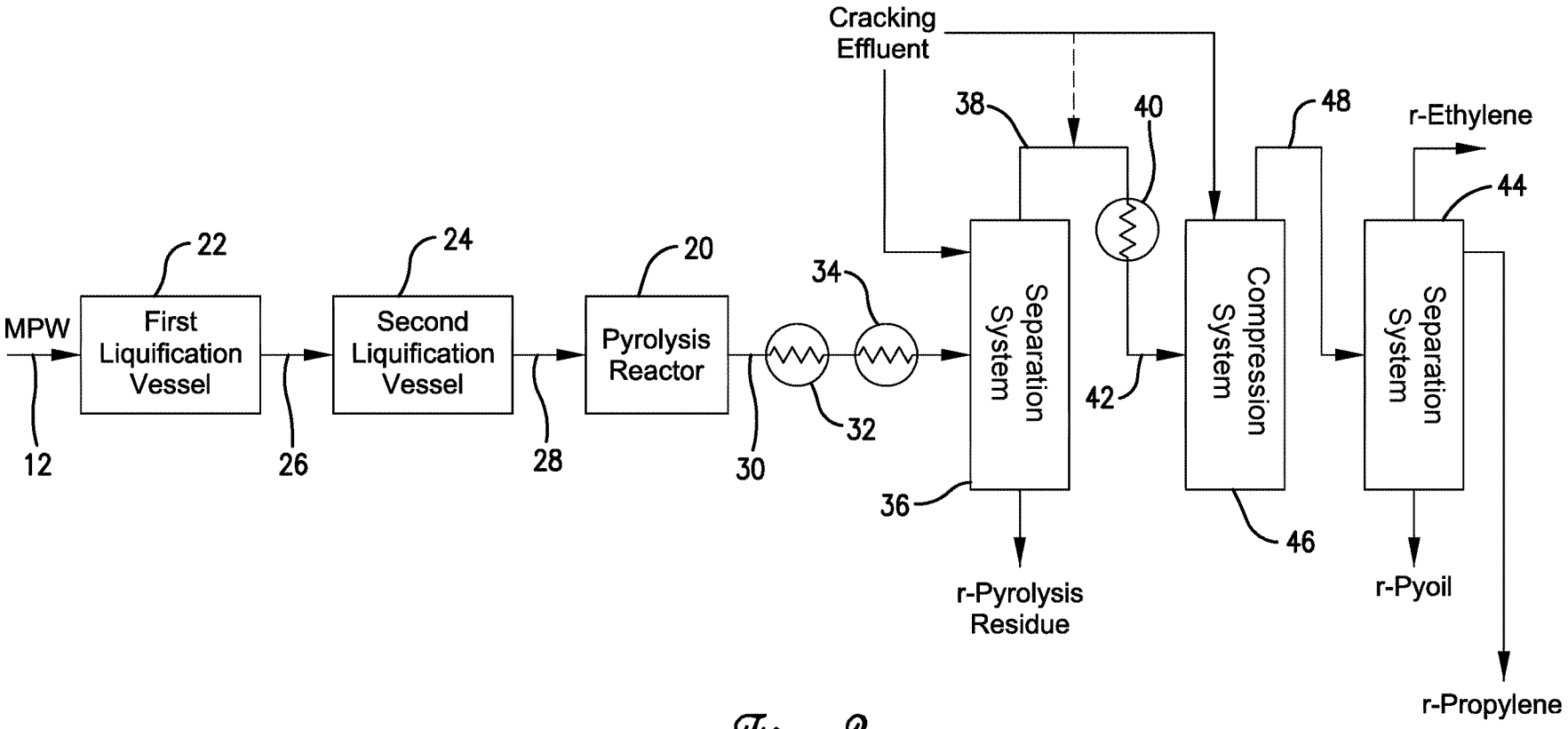
FIG. 3 is a block flow diagram illustrating more specific steps of a process and facility for chemically recycling waste plastic according to embodiments of the present technology.

As shown in FIG. 3, at least a portion of the pyrolysis vapor stream may be separated in a first separation system 36 and then subsequently compressed in a compression system 46 to form a compressed pyrolysis vapor 48. The compressed pyrolysis vapor 48 may then be treated in a second separation system 44 so as to form a recycle content pyrolysis oil stream, a recycle content ethylene stream, and a recycle content propylene stream.

Furthermore, as shown in FIG. 3, a cracking effluent from a cracking facility may be co-fed with the pyrolysis vapor stream in the first separation system 36 and/or the compression system 46.

In an embodiment or in combination with any embodiment mentioned herein, the first separation system 36 can include various types of equipment including, but not limited to a filter system, a multistage separator, a gasoline fractionator, a condensation zone, a distillation column, and/or a quench tower. For example, the first separation system 36 may comprise at least a gasoline fractionator followed by a quench tower.

In an embodiment or in combination with any embodiment mentioned herein, the fractionation section of the second separation system 44 may include at least one or more of a second compression system, a demethanizer, a deethanizer, a depropanizer, an ethylene splitter, a propylene splitter, a debutanizer, and combinations thereof. As used herein, the term "demethanizer," refers to a column whose light key component is methane. Similarly, "deethanizer," and "depropanizer," refer to columns with ethane and propane as the light key component, respectively.

In an embodiment or in combination with any embodiment mentioned herein, the first separation system 36, the compression system 46, and/or second separation system 44 may be contained within a cracking facility that is co-located with the pyrolysis facility. Thus, at least a portion of the pyrolysis vapor stream may be co-processed with a cracking effluent from the cracking facility in the first separation system 36, the compression system 46, and/or second separation system 44 in the cracking facility.

Alternatively, in an embodiment or in combination with any embodiment mentioned herein, the first separation system 36, the compression system 46, and/or second separation system 44 may not be contained within a cracking facility and/or may not be in fluid communication with a cracking facility.

In an embodiment or in combination with any embodiment mentioned herein, the first separation system 36, the compression system 46, and/or second separation system 44 may not be in fluid communication with a cracking effluent from a cracking facility.

In an embodiment or in combination with any embodiment mentioned herein, the cracking effluent co-processed with the pyrolysis vapor stream can comprise a recycle content cracking effluent that has been directly or indirectly derived from waste plastics.

In an embodiment or in combination with any embodiment mentioned herein, the first separation system 36, the second separation system 44, and/or the compression system 46 depicted in FIG. 3 can be located in a cracking facility that is co-located with the pyrolysis facility. In such embodiments, the pyrolysis facility may be in fluid communication with the cracking facility. However, even if the pyrolysis facility is in fluid communication with a cracking facility, a cracking reactor (e.g., a cracking furnace) may not be located downstream of the pyrolysis reactor since the pyrolysis effluent does not require any further cracking. Rather, the pyrolysis effluent can simply utilize the existing separation systems and/or compression systems already present in the cracking facility.

Any suitable arrangement of columns in the second separation system 44 may be used so that the fractionation section. In an embodiment or in combination with any embodiment mentioned herein, the fractionation section can provide at least two recycle content olefin streams, such as ethylene and propylene, and at least two recycle content paraffin streams, such as ethane and propane, as well as additional streams including, for example, methane and lighter components and butane and heavier components.

In an embodiment or in combination with any embodiment mentioned herein, the pyrolysis vapor stream can comprise at least 10, at least 15, at least 20, at least 25, at least 30, at least 35, at least 40, at least 45, or at least 50 weight percent of recycle content C2 to C4 olefins, based on the total weight of the pyrolysis vapor stream.

As the pyrolysis vapor stream passes through the second separation system 44, it may pass through a demethanizer column, wherein the methane and lighter (CO, $CO_2$, $H_2$) components are separated from the ethane and heavier components. The overhead stream from the demethanizer column may comprise at least 50, or at least 55, or at least 60, or at least 65, or at least 70, or at least 75, or at least 80, or at least 85, or at least 90, or at least 95 or at least 99 weight percent of methane, based on the total weight of the stream. This overhead stream may be removed from the cracking facility and be referred to as the recycle content methane (r-methane) stream.

Meanwhile, the bottoms stream from the demethanizer column may include at least 50, or at least 55, or at least 60, or at least 65, or at least 70, or at least 75, or at least 80, or at least 85, or at least 90, or at least 95 or at least 99, in each case percent of the total amount of ethane and heavier components.

In an embodiment or in combination with any embodiment mentioned herein, all or a portion of the pyrolysis vapor stream introduced into the second separation system 44 can be introduced into a deethanizer column, wherein the C2 and lighter components are separated from the C3 and heavier components by fractional distillation. The deethanizer column may recover at least 60, or at least 65, or at least 70, or at least 75, or at least 80, or at least 85, or at least 90, or at least 95, or at least 97, or at least 99, in each case percent of the total amount of C2 and lighter components introduced into the column in the overhead stream. The overhead stream removed from the deethanizer column comprises at least 50, or at least 55, or at least 60, or at least 65, or at least 70, or at least 75, or at least 80, or at least 85, or at least 90, or at least 95, in each case weight percent of ethane and ethylene, based on the total weight of the overhead stream.

In an embodiment or in combination with any embodiment mentioned herein, the C2 and lighter overhead stream from a deethanizer can be further separated in an ethane-ethylene fractionator column (ethylene fractionator or ethylene splitter). In the ethane-ethylene fractionator column, an ethylene and lighter component stream can be withdrawn from the overhead of the column or as a side stream from the top half of the column, while the ethane and any residual heavier components are removed in the bottoms stream. The overhead stream, which may be enriched in ethylene, can include at least 70, or at least 75, or at least 80, or at least 85, or at least 90, or at least 95, or at least 97, or at least 98, or at least 99, in each case weight percent ethylene, based on the total weight of the stream and may be sent to downstream processing unit for further processing, storage, or sale. This removed ethylene may comprise recycle content ethylene (i.e., r-ethylene).

In an embodiment or in combination with any embodiment mentioned herein, at least a portion of the pyrolysis vapor stream may be separated in a depropanizer, wherein C3 and lighter components are removed as an overhead vapor stream, while C4 and heavier components exit the column in the liquid bottoms. The depropanizer column may recover at least 60, or at least 65, or at least 70, or at least 75, or at least 80, or at least 85, or at least 90, or at least 95, or at least 97, or at least 99, in each case percent of the total amount of C3 and lighter components introduced into the column in the overhead stream. In an embodiment or in combination with any embodiment mentioned herein, the overhead stream removed from the depropanizer column comprises at least or at least 50, or at least 55, or at least 60, or at least 65, or at least 70, or at least 75, or at least 80, or at least 85, or at least 90, or at least 95, or at least 98, in each case weight percent of propane and propylene, based on the total weight of the overhead stream.

In an embodiment or in combination with any embodiment mentioned herein, the overhead stream from the depropanizer may be introduced into a propane-propylene fractionator (propylene fractionator or propylene splitter), wherein the propylene and any lighter components are removed in the overhead stream and the propane and any heavier components exit the column in the bottoms stream. The overhead stream, which is enriched in propylene, can include at least 70, or at least 75, or at least 80, or at least 85, or at least 90, or at least 95, or at least 97, or at least 98, or at least 99, in each case weight percent propylene, based on the total weight of the stream and may be sent to downstream processing unit for further processing, storage, or sale. This removed propylene may comprise recycle content ethylene (i.e., r-propylene).

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the phrase "at least a portion" includes at least a portion and up to and including the entire amount or time period.

As used herein, "aqueous" refers to a fluid containing at least five percent of molecular water by weight.

As used herein, the term "aromatics recovery facility" refers to a facility that includes all equipment, lines, and controls necessary to recover at least a portion of the aromatics present in a feed stream.

As used herein, the term "bottom" refers to the physical location of a structure that is below the other noted structures within an enclosed structure. For example, a "bottom" stream is a stream taken from a vessel at a position that is lower elevation-wise to other streams taken from the vessel, such as an "overhead" stream.

As used herein, the term "chemical recycling" refers to a waste plastic recycling process that includes a step of chemically converting waste plastic polymers into lower molecular weight polymers, oligomers, monomers, and/or non-polymeric molecules (e.g., hydrogen, carbon monoxide, methane, ethane, propane, ethylene, and propylene) that are useful by themselves and/or are useful as feedstocks to another chemical production process(es).

As used herein, the term "chemical recycling facility" refers to a facility for producing a recycle content product via chemical recycling of waste plastic.

As used herein, the term "co-located" refers to the characteristic of at least two objects being situated on a common physical site, and/or within one mile of each other.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the term "cracking" refers to breaking down complex organic molecules into simpler molecules by the breaking of carbon-carbon bonds.

As used herein, the term "depleted" refers to having a concentration (on a dry weight basis) of a specific component that is less than the concentration of that component in a reference material or stream.

As used herein, the term "directly derived" refers to having at least one physical component originating from waste plastic.

As used herein, the term "enriched" refers to having a concentration (on a dry weight basis) of a specific component that is greater than the concentration of that component in a reference material or stream.

As used herein, the terms "exhaustion" or "exhausting" refer to methods for disposing of the specified stream by removing the stream from the facility. Exemplary exhaustion methods can include venting.

As used herein, the term "fluid" may encompass a liquid, a gas, a supercritical fluid, or a combination thereof.

As used herein, the term "halide" refers to a composition comprising a halogen atom bearing a negative charge (i.e., a halide ion).

As used herein, the term "halogen" or "halogens" refers to organic or inorganic compounds, ionic, or elemental species comprising at least one halogen atom.

As used herein, the terms "having," "has," and "have" have the same open-ended meaning as "comprising," "comprises," and "comprise" provided above.

As used herein, a "heat transfer medium loop" or "HTM loop" refers to a system comprising one or more heat exchangers through which a common HTM is circulated to a common HTM supply or a part of a larger system for the purpose of transferring heat and/or energy into and/or out of the chemical recycling process.

As used herein, the terms "including," "include," and "included" have the same open-ended meaning as "comprising," "comprises," and "comprise" provided above.

As used herein, the term "indirectly derived" refers to having an assigned recycle content i) that is attributable to waste plastic, but ii) that is not based on having a physical component originating from waste plastic.

As used herein, the term "isolated" refers to the characteristic of an object or objects being by itself or themselves and separate from other materials, in motion or static.

As used herein, the terms "mixed plastic waste" and "MPW" refer to a mixture of at least two types of waste plastics including, but not limited to the following plastic types: polyethylene terephthalate (PET), one or more polyolefins (PO), and polyvinylchloride (PVC).

As used herein, "non-aqueous" refers to a fluid containing less than five percent of molecular water by weight.

As used herein, the term "overhead" refers to the physical location of a structure that is above a maximum elevation of quantity of particulate plastic solids within an enclosed structure. For example, an "overhead" stream is a stream taken from a vessel at a position that is higher elevation-wise to other streams taken from the vessel, such as a "bottom" stream.

As used herein, the term "partially processed waste plastic" means waste plastic that has been subjected to at least on automated or mechanized sorting, washing, or comminuted step or process. Partially processed waste plastics may originate from, for example, municipal recycling facilities (MRFs) or reclaimers. When partially processed waste plastic is provided to the chemical recycling facility, one or more preprocessing steps may me skipped.

As used herein, the term "physical recycling" (also known as "mechanical recycling") refers to a waste plastic recycling process that includes a step of melting waste plastic and forming the molten plastic into a new intermediate product (e.g., pellets or sheets) and/or a new end product (e.g., bottles). Generally, physical recycling does not substantially change the chemical structure of the plastic, although some degradation is possible.

As used herein, the term "plastic" may include any organic synthetic polymers that are solid at 25° C. and 1 atmosphere of pressure.

As used herein, the terms "partial oxidation (POX) gasification" or "POX gasification" refers to high temperature conversion of a carbon-containing feed into syngas, (carbon monoxide, hydrogen, and carbon dioxide), where the conversion is carried out in the presence of a less than stoichiometric amount of oxygen. The feed to POX gasification can include solids, liquids, and/or gases.

As used herein, the term "partial oxidation (POX) reaction" refers to all reactions occurring within a partial oxidation (POX) gasifier in the conversion of a carbon-containing feed into syngas, including but not limited to partial oxidation, water gas shift, water gas-primary reactions, Boudouard, oxidation, methanation, hydrogen reforming, steam reforming, and carbon dioxide reforming.

As used herein, the term "predominantly" means more than 50 percent by weight. For example, a predominantly propane stream, composition, feedstock, or product is a stream, composition, feedstock, or product that contains more than 50 weight percent propane.

As used herein, the term "preprocessing" refers to preparing waste plastic for chemical recycling using one or more of the following steps: (i) comminuting, (ii) particulating, (iii) washing, (iv) drying, and/or (v) separating.

As used herein, the term "pyrolysis" refers to thermal decomposition of a feedstock of a biomass and/or a plastic material in solid or liquid form at elevated temperatures in an inert (i.e., substantially molecular oxygen free) atmosphere.

As used herein, the term "pyrolysis char" refers to a carbon-containing composition obtained from pyrolysis that is solid at 200° C. and 1 atm.

As used herein, the terms "pyrolysis gas" and "pygas" refer to a composition obtained from pyrolysis that is gaseous at 25° C. at 1 atm.

As used herein, the term "pyrolysis heavy waxes" refers to C20+ hydrocarbons obtained from pyrolysis that are not pyrolysis char, pyrolysis gas, or pyrolysis oil.

As used herein, the terms "pyrolysis oil" or "pyoil" refers to a composition obtained from pyrolysis that is liquid at 25° C. and 1 atm.

As used herein, the term "pyrolysis residue" refers to a composition obtained from pyrolysis that is not pyrolysis gas or pyrolysis oil and that comprises predominantly pyrolysis char and pyrolysis heavy waxes.

As used herein, the terms "recycle content" and "r-content" refer to being or comprising a composition that is directly and/or indirectly derived from waste plastic.

As used herein, the terms "recycle content ethylene" or "r-ethylene" refer to being or comprising ethylene that is directly and/or indirectly derived from waste plastic.

As used herein, the terms "recycle content propylene" or "r-propylene" refer to being or comprising propylene that is directly and/or indirectly derived from waste plastic.

As used herein, the terms "r-pyrolysis gas" or "r-pygas" refer to being or comprising a pyrolysis gas that is directly and/or indirectly derived from waste plastic.

As used herein, the terms "r-pyrolysis oil" or "r-pyoil" refer to being or comprising a pyrolysis oil that is directly and/or indirectly derived from waste plastic.

As used herein, the term "residual" refers to a remaining quantity or amount of an identified product or component that remains from an original source containing the product or component. For example, a "residual pyrolysis oil" may refer to the remaining pyrolysis oil from an initial pyrolysis effluent after the majority of the pyrolysis oil has been previously removed therefrom.

As used herein, the terms "waste plastic" and "plastic waste" refer to used, scrap, and/or discarded plastic materials. The waste plastic fed to the chemical recycling facility may be unprocessed or partially processed.

As used herein, the term "unprocessed waste plastic" means waste plastic that has not be subjected to any automated or mechanized sorting, washing, or comminuting. Examples of unprocessed waste plastic include waste plastic collected from household curbside plastic recycling bins or shared community plastic recycling containers.

As used herein, "downstream" means a target unit operation, vessel, or equipment that:

a. is in fluid (liquid or gas) communication, or in piping communication, with an outlet stream from the radiant section of a cracker furnace, optionally through one or more intermediate unit operations, vessels, or equipment, or b. was in fluid (liquid or gas) communication, or in piping communication, with an outlet stream from the radiant section of a cracker furnace, optionally through one or more intermediate unit operations, vessels, or equipment, provided that the target unit operation, vessel, or equipment remains within the battery limits of the cracker facility (which includes the furnace and all associated downstream separation equipment).

CLAIMS NOT LIMITED TO DISCLOSED EMBODIMENTS

When a numerical sequence is indicated, it is to be understood that each number is modified the same as the first number or last number in the numerical sequence or in the sentence, e.g., each number is "at least," or "up to" or "not more than" as the case may be; and each number is in an "or" relationship. For example, "at least 10, 20, 30, 40, 50, 75 wt. % . . . " means the same as "at least 10 wt. %, or at least 20 wt. %, or at least 30 wt. %, or at least 40 wt. %, or at least 50 wt. %, or at least 75 wt. %," etc.; and "not more than 90 wt. %, 85, 70, 60 . . . " means the same as "not more than 90 wt. %, or not more than 85 wt. %, or not more than 70 wt. % . . . " etc.; and "at least 1%, 2%, 3%, 4%, 5%, 6%, 7%, 8%, 9% or 10% by weight . . . " means the same as "at least 1 wt. %, or at least 2 wt. %, or at least 3 wt. % . . . " etc.; and "at least 5, 10, 15, 20 and/or not more than 99, 95, 90 weight percent" means the same as "at least 5 wt. %, or at least 10 wt. %, or at least 15 wt. % or at least 20 wt. % and/or not more than 99 wt. %, or not more than 95 wt. %, or not more than 90 weight percent . . . " etc.

The preferred forms of the invention described above are to be used as illustration only and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A chemical recycling process comprising:

(a) melting a solid waste plastic in a plastic liquification system to thereby form a pyrolysis effluent stream having a temperature of at least 500° C.; and (b) pyrolyzing at least a portion of the pyrolysis effluent stream in a pyrolysis reactor at a temperature from 750° C. to 120° C. to thereby form a pyrolysis vapor stream, wherein the pyrolysis vapor stream comprises less than 10 weight percent of C6-C9 hydrocarbons, and less than 15 weight percent of C10-C25 hydrocarbons before any separation in a downstream separation system.

2. The chemical recycling process according to claim 1, further comprising introducing at least a portion of the pyrolysis vapor stream into a compression system without further separation.

3. The chemical recycling process according to claim 1, further comprising separating at least a portion of the pyrolysis vapor stream into a pyrolysis oil stream and a pyrolysis gas stream.

4. The chemical recycling process according to claim 3, wherein at least a portion of the pyrolysis gas stream is introduced into a compression system.

5. The chemical recycling process according to claim 1, wherein the pyrolysis reactor and/or the liquification system comprise a heating system for providing heat, wherein the heating system comprises at least one electric heater.

6. The chemical recycling process according to claim 1, wherein the liquification system comprises a first liquification vessel and a second liquification vessel, wherein the interior of the first liquification vessel is maintained at a temperature of at least 225° C., and the interior of the second liquification vessel is maintained at a temperature of at least 350° C.

7. The chemical recycling process according to claim 1, wherein the pyrolysis vapor stream comprises at least 10 weight percent of ethylene on a dry-basis, or at least 10 propylene on a dry-basis, or at least 3 weight percent of methane on a dry-basis.

8. The chemical recycling process according to claim 1, wherein the pyrolysis vapor stream comprises less than 10 weight percent of C6-C9 hydrocarbons on a dry-basis.

9. The chemical recycling process according to claim 8, wherein the pyrolysis vapor stream comprises less than 15 weight percent of C10-C25 hydrocarbons on a dry-basis.

10. The chemical recycling process according to claim 1, wherein the pyrolysis effluent stream has a temperature of at least 525° C.

11. The chemical recycling process according to claim 1, further comprising adding a steam stream to the pyrolysis reactor.

12. The chemical recycling process according to claim 1, further comprising recovering a recycle content ethylene stream and/or a recycle content propylene stream from the pyrolysis vapor stream, wherein the recycle content ethylene stream and/or the recycle content propylene stream are in fluid communication with the pyrolysis vapor stream.

13. The chemical recycling process according to claim 1, further comprising co-feeding a cracking effluent stream with at least a portion of the pyrolysis vapor stream in a separation system and/or the compression system.

14. The chemical recycling process according to claim 13, wherein the melting and the pyrolyzing occur in a pyrolysis facility and the separation system and the compression system are located in a cracking facility, wherein the pyrolysis facility is co-located to the cracking facility.

15. The chemical recycling process according to claim 1, further comprising introducing at least a portion of the pyrolysis vapor stream into a quench tower to thereby form a recycle content pyrolysis oil stream.

16. The chemical recycling process according to claim 15, further comprising introducing at least a portion of the pyrolysis vapor stream into a gasoline fractionator prior to the introducing into the quench tower.

17. A chemical recycling process comprising:

(a) melting a solid waste plastic in a plastic liquification system to thereby form a pyrolysis effluent stream having a temperature of at least 400° C.; and (b) pyrolyzing at least a portion of the pyrolysis effluent stream in a pyrolysis reactor at a temperature from 750° C. to 1200° C. to thereby form a pyrolysis vapor stream, wherein the pyrolysis vapor stream before any separation in a downstream separation system contains—

(i) at least 10 weight percent of ethylene, (ii) at least 10 weight percent of propylene, (iii) at least 3 weight percent of methane, (iv) less than 10 weight percent of butylene, (v) less than 10 weight percent of C6-C9 hydrocarbons, and (vi) less than 15 weight percent of C10-C25 hydrocarbons.

18. The chemical recycling process according to claim 17, further comprising introducing at least a portion of the pyrolysis vapor stream into a compression system without further separation.

19. The chemical recycling process according to claim 17, further comprising separating at least a portion of the pyrolysis vapor stream into a pyrolysis oil stream and a pyrolysis gas stream, and at least a portion of the pyrolysis oil stream and/or the pyrolysis gas stream is introduced into a compression system.

20. A chemical recycling process comprising:

(a) melting a solid waste plastic in a plastic liquification vessel to thereby form liquefied waste plastic having a temperature of at least 275° C.;

(b) heating at least a portion of the liquefied waste plastic in a heating vessel to thereby form a pyrolysis effluent stream having a temperature of at least 400° C.;

(c) pyrolyzing at least a portion of the pyrolysis effluent stream in a pyrolysis reactor at a temperature from 750° C. to 1200° C. to thereby form a pyrolysis vapor stream, wherein the pyrolysis vapor stream comprises less than 10 weight percent of C6-C9 hydrocarbons, and less than 15 weight percent of C10-C25 hydrocarbons before any separation in a downstream separation system; and (d) introducing at least a portion of the pyrolysis vapor stream into a compression system.

* * * * *